United States Patent [19]

Evers

[11] Patent Number: 4,614,074

[45] Date of Patent: Sep. 30, 1986

[54] APPARATUS FOR SERIALLY INSERTING STRAWS INTO POUCHES

[75] Inventor: Jack R. Evers, Coronado, Calif.

[73] Assignee: Flex Straw Limited, Delmar, Calif.

[21] Appl. No.: 627,854

[22] Filed: Jul. 5, 1984

[51] Int. Cl.[4] ..... B65B 61/00

[52] U.S. Cl. ..... 53/128; 53/236; 53/410; 414/128; 294/86.4

[58] Field of Search ..... 53/128, 133, 154, 155, 53/236, 237, 239, 240, 250, 410; 221/210, 221, 223; 414/128; 294/86.4, 106, 115, 901, 902

[56] References Cited

U.S. PATENT DOCUMENTS

| | | | |
|---|---|---|---|
| 2,282,576 | 5/1942 | Hamilton et al. | 53/239 X |
| 2,445,958 | 7/1948 | Lindstrom | 221/223 |
| 2,584,466 | 2/1952 | Kaserman | 221/210 X |
| 3,019,575 | 2/1962 | Charley et al. | 53/239 X |
| 3,126,127 | 3/1964 | Lovendusky | 221/210 |
| 3,390,812 | 7/1968 | Bono | 221/210 X |
| 3,661,278 | 5/1972 | Hammerle | 221/221 X |
| 3,742,678 | 7/1973 | Wyatt | 53/236 |

FOREIGN PATENT DOCUMENTS

| | | | |
|---|---|---|---|
| 2056939 | 3/1981 | United Kingdom | 53/236 |

*Primary Examiner*—John Sipos
*Assistant Examiner*—Steven P. Weihrouch
*Attorney, Agent, or Firm*—Charles E. Brown; Charles A. Brown

[57] ABSTRACT

This relates to a series of cooperating mechanisms which be individually actuated. Specifically, the mechanisms include a first mechanism for engaging a tubular member, such as a straw, and removing the same from a dispensing unit. The tubular member may then be engaged by a second mechanism which will move it into a desired release position, such as within a pouch. A second mechanism may be utilized individually and includes a crank arm which carries a transfer unit which pivots relative to the crank arm and which includes a support blade having associated therewith jaw members. The two mechanisms are preferably driven by cams carried by a common drive shaft and wherein at least two of the cams have associated therewith return springs. The operation of the two mechanisms, when utilized in unison, is such that one spring counterbalances the other. There is also provided a dispensing unit for dispensing tubular members, one at a time, at a fixed position. The tubular members may be lightweight elements, such as straws.

30 Claims, 27 Drawing Figures

30
31
32
33
34
35
36
37
38
40
41
42
43
44
45
81
A
B
P
S

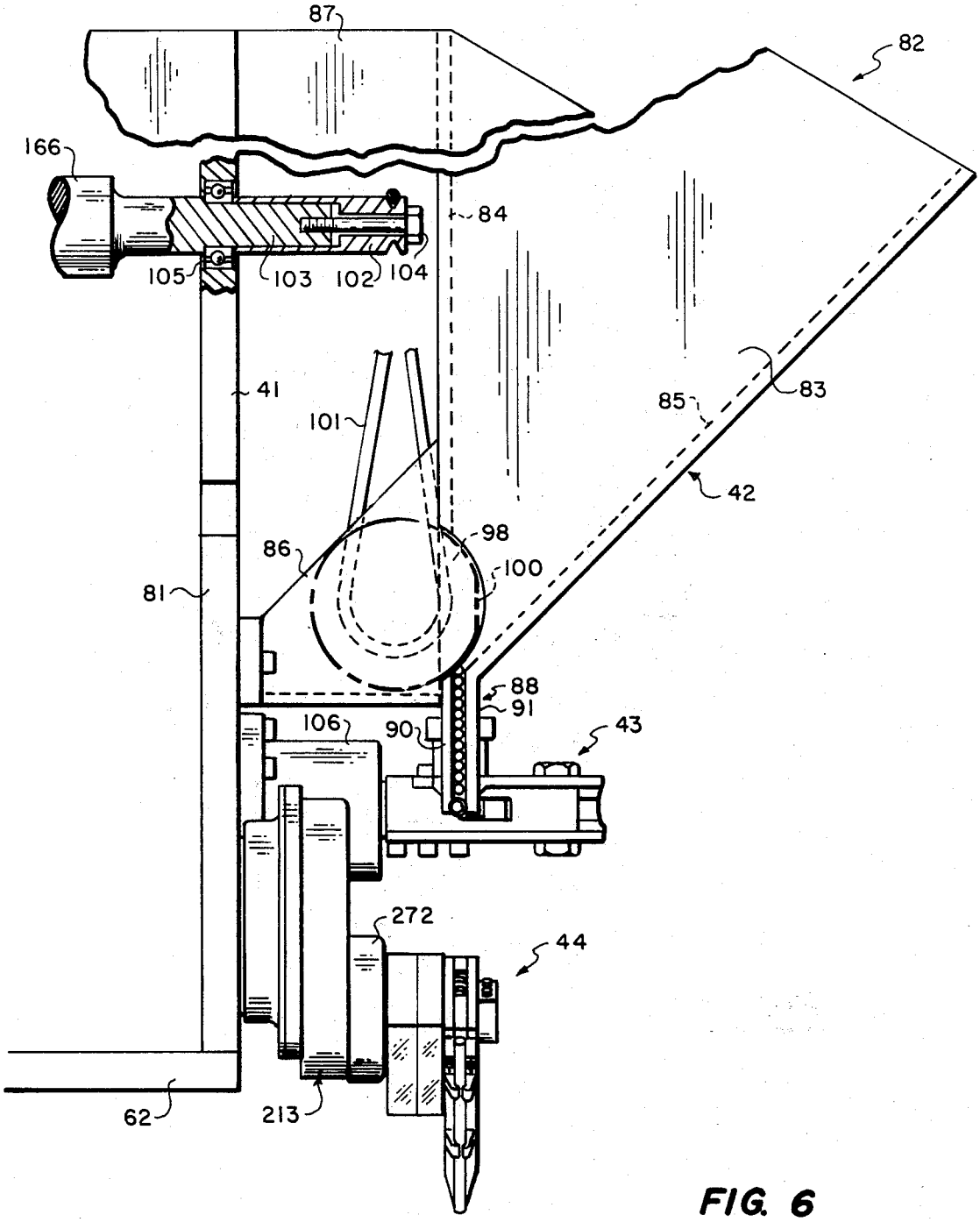
FIG. 6
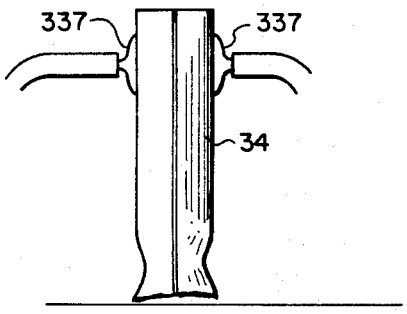

FIG. 13
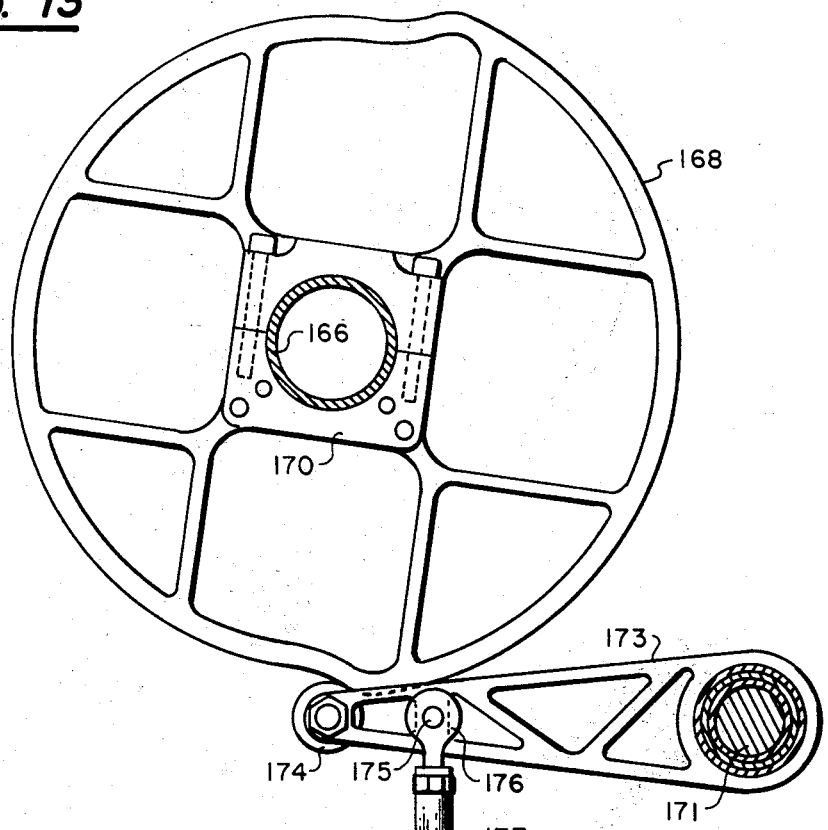
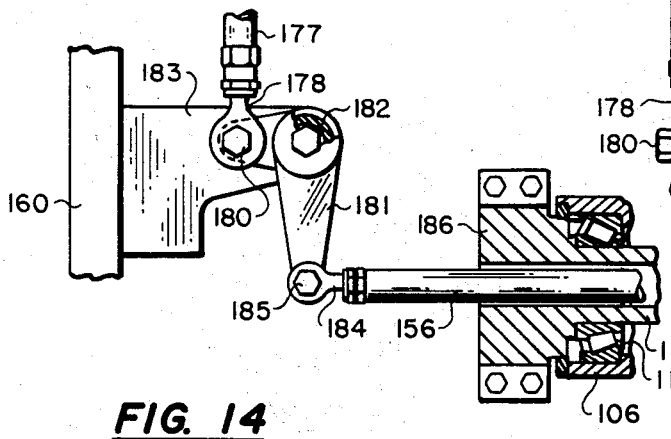
FIG. 14

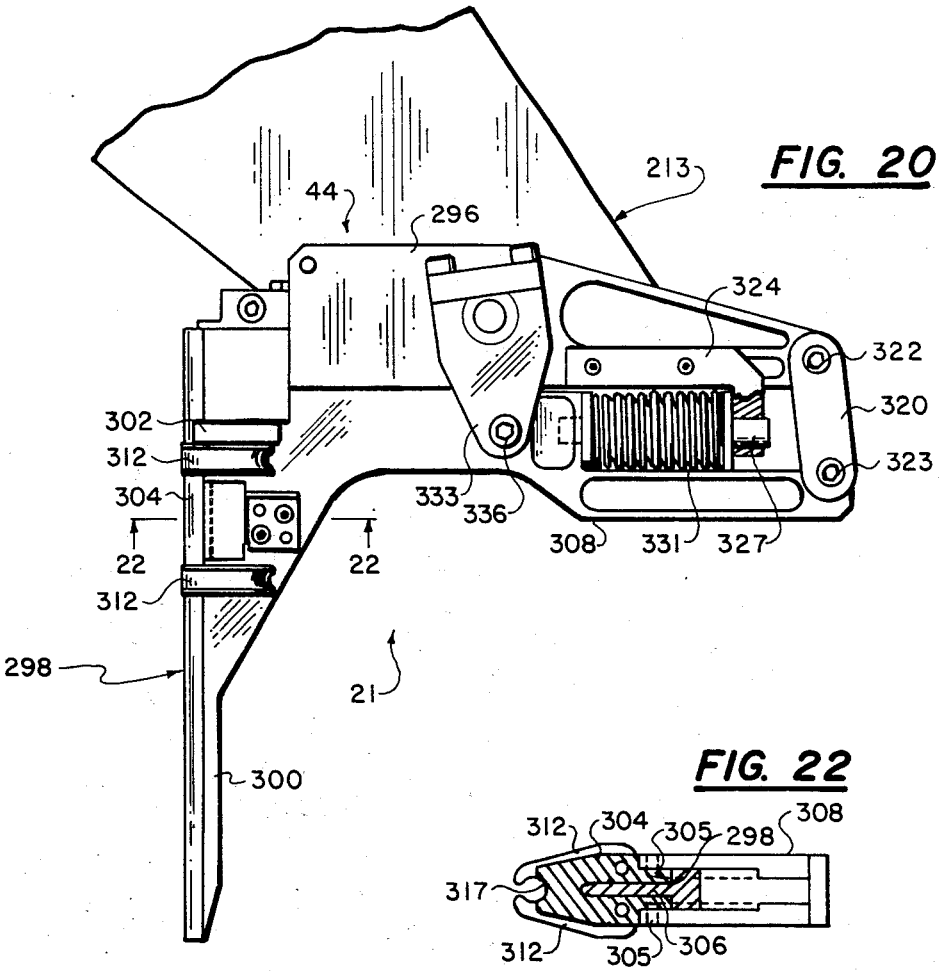
FIG. 20
FIG. 22
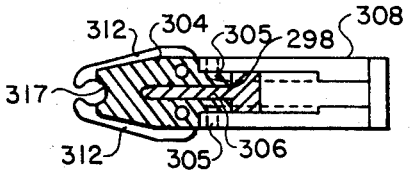
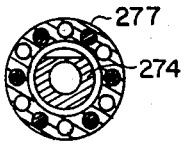
FIG. 23
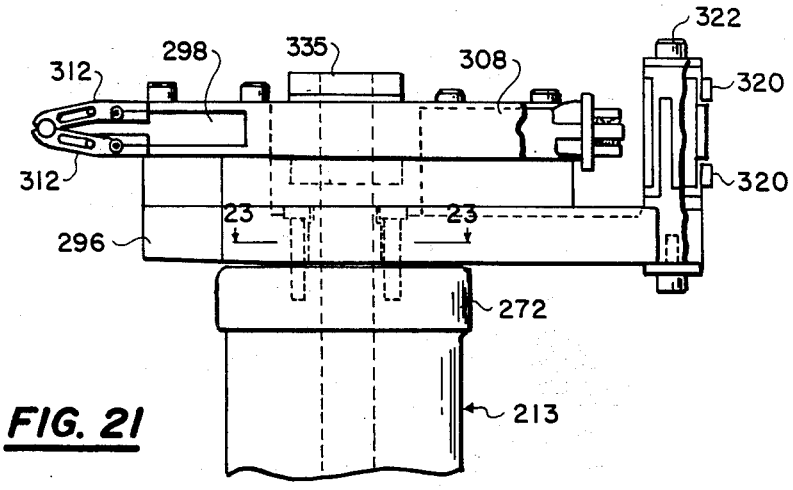
FIG. 21

DISPLACEMENT ANGLE

| FUNCTION | 0 | 16.5 | 33 | 49.5 | 66 |
|---|---|---|---|---|---|
| NORMAL R | 1.400 | 1.750 | 1.94 | 2.03 | 1.94 |
| L ℄-℄ | 15.062 | 14.595 | 14.063 | 13.469 | 12.906 |
| L SPRING= L℄℄ -5.005 | 10.057 | 9.59 | 9.058 | 8.464 | 7.901 |
| DEF = LF - L SPRING | 1.943 | 2.41 | 2.942 | 3.535 | 4.095 |
| LOAD = DEF. x RATE LB/IN20.9 | 40.608 | 50.369 | 61.487 | 73.88 | 85.58 |
| SPRING TORQ. R x LOAD | 56.95 | 88.2 | 1.93 | 150 | 166 |

ESCAPE ARM ANALYSIS

——— DYNAMIC TORQUE

—·—·— SPRING TORQUE

- - - - - - - - D+S = SEATING TORQUE

DISPLACEMENT ANGLE

| FUNCTION | 0 | 15 | 30 | 45 | 60 |
|---|---|---|---|---|---|
| NORMAL R | 1.750 | 2.093 | 2.312 | 2.375 | 2.281 |
| L ℄·℄ | 13.375 | 12.873 | 12.312 | 11.688 | 11.062 |
| Lspring =L℄℄ -3.737 | 9.638 | 9.138 | 8.575 | 7.950 | 7.325 |
| DEF.=LF-Lspring | 2.362 | 2.862 | 3.425 | 4.049 | 4.675 |
| LOAD=DEF.x20.9 | 4.936 | 59.81 | 71.58 | 84.63 | 97.70 |
| SPRING TORQUE R x LOAD | 86.39 | 125.194 | 165.5 | 201 | 222.9 |

STUFFING ARM ANALYSIS

——— DYNAMIC TORQUE

—·—·—·— SPRING TORQUE

- - - - - - - - D+S=SEATING TORQUE

APPARATUS FOR SERIALLY INSERTING STRAWS INTO POUCHES

This invention relates in general to new and useful improvements in transfer mechanisms, and more particularly to an apparatus for serially inserting straws into pouches.

It is known to provide a web which is folded longitudinally about a center after which it is sequentially heat sealed transversely of the fold to define a plurality of pouches having open tops. These pouches are then gripped and moved serially in spaced relation beneath a suitable filling mechanism which fills the pouches with the desired product. Afterwards the open ends of the pouches are closed. A common make of such machines is a Bartelt.

This invention in particular relates to an apparatus for placing a straw in each of the pouches before the product is placed therein. The straw will be later used in drinking a liquid which has been formed by mixing the product with water.

Broadly speaking, this invention relates to an apparatus which will transfer a horizontal tubular member through an arcuate path and present such tubular member to a further mechanism which will take that tubular member and further rotate that tubular member to a generally vertical but over-center position.

One feature of the invention is to provide a transfer apparatus which may be mounted on an existing pouch forming and filling machine and may be driven from the drive train of such machine. The mounting of the apparatus is such that is may be moved for adjustment longitudinally of the machine, transversely of the machine and vertically of the machine.

Another feature of the invention is the provision of a device for serializing straws from within a hopper so that one straw at a time is presented at the bottom of the hopper.

Another feature of the invention is the provision of an escapement mechanism for picking a presented tubular member, such as a straw, engaging such tubular member at the ends by way of pins presented thereinto and then transporting the tubular member.

Yet another feature of the invention is the provision of a stuffer mechanism which will engage a tubular member, such as a straw, in a manner to fully support the straw while gripping the straw adjacent one end portion thereof so that the straw may be presented into a pouch or like confined area.

A further feature of the invention is to provide in a transfer apparatus first and second transfer mechanisms which are driven by cams mounted on a common shaft and wherein there is associated with each cam a return spring and wherein the relationship of the transfer mechanisms is such that when one spring is being compressed, the other spring is being relaxed so that the springs generally cancel one another thereby reducing the torque load on the common shaft for the cams.

Yet another feature of the invention is the specific details of the escapement mechanism for both picking up tubular members and for adjusting the same to accommodate tubular members of different lengths.

Yet another feature of the invention is the specific details of the escapement mechanism which includes an oscillating arm which is mounted for oscillation at one end and which carries at the opposite end a carrier, which carrier is mounted for oscillation relative to the arm and wherein the carrier includes a clamp mechanism which is actuated by yet a further shaft.

It is to be understood that the above defined features are not required for use all at one time but may be utilized singularly or in combination with one another.

With the above and other objects in view that will hereinafter appear, the nature of the invention will be more clearly understood by reference to the following detailed description, the appended claims, and the several views illustrated in the accompanying drawings.

FIG. 6 is a side elevational view of the apparatus of FIG. 4 with parts broken away and shows the specific details of means for presenting straws serially at the mouth of a hopper.

FIG. 13 is an elevational view showing specifically the details of a cam drive mechanism for effecting the separation of straw engagement pins of the escapement arm assembly.

FIG. 14 is a fragmentary elevational view taken generally in the direction of the arrow 14 of FIG. 13 and shows further the details of the drive for opening and closing the pins.

Figure 17:
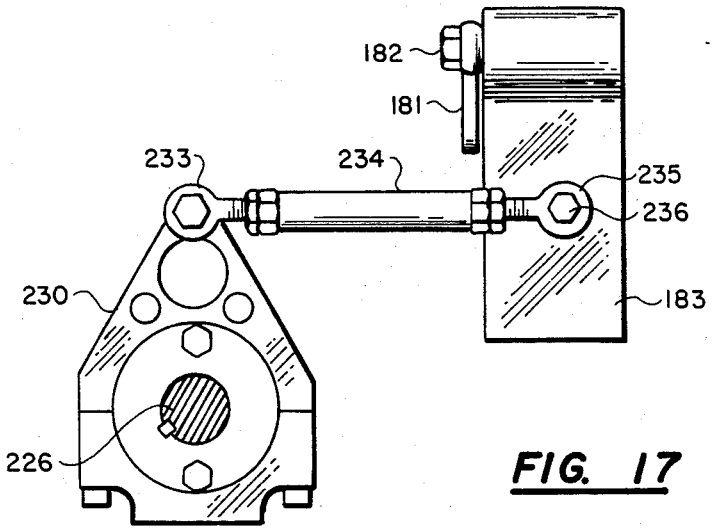
Figure 10:
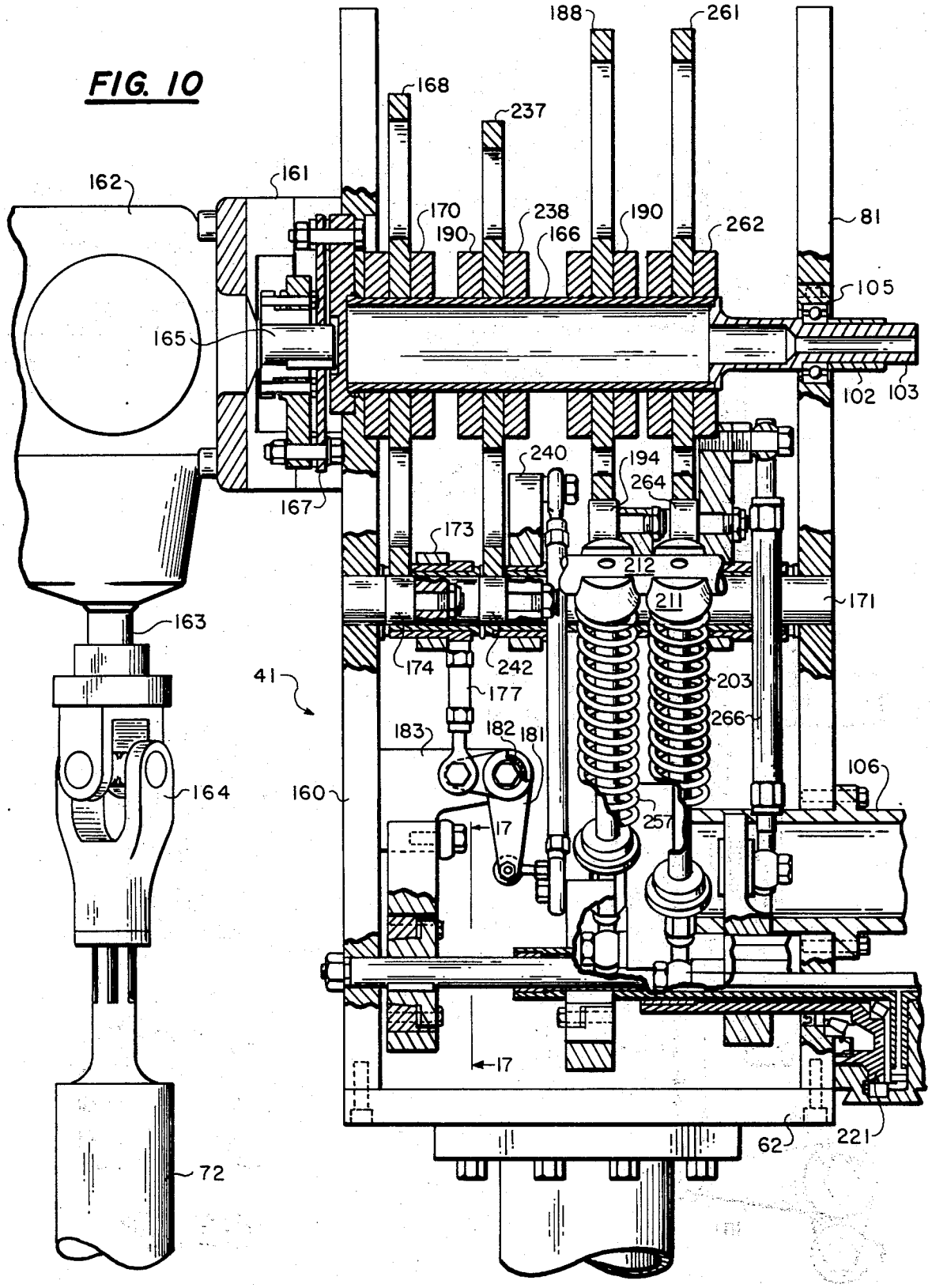
FIG. 10 is an elevational view with parts broken away taken through the drive mechanism of the apparatus and shows generally the details thereof.

FIG. 17 is a fragmentary sectional view taken generally along the line 17—17 of FIG. 10 and shows the manner in which a clamp control shaft of the stuffer arm assembly is adjusted to control the timing of the opening and closing of the clamps.

Figure 18:
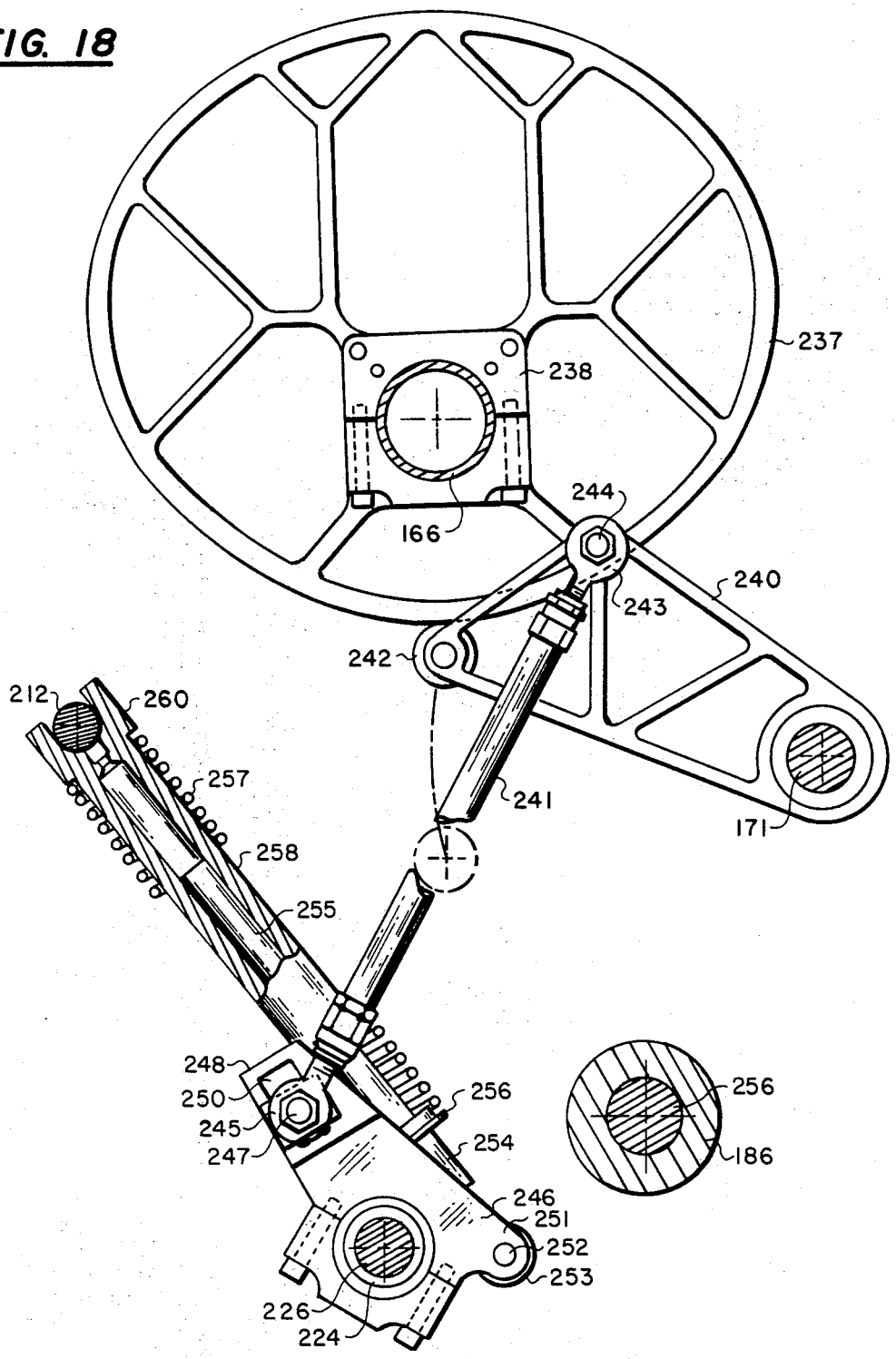

FIG. 18 is an elevational view with parts broken away and shown in section of the cam drive for effecting the oscillation of a straw carrier blade relative to the stuffer arm.

Figure 19:
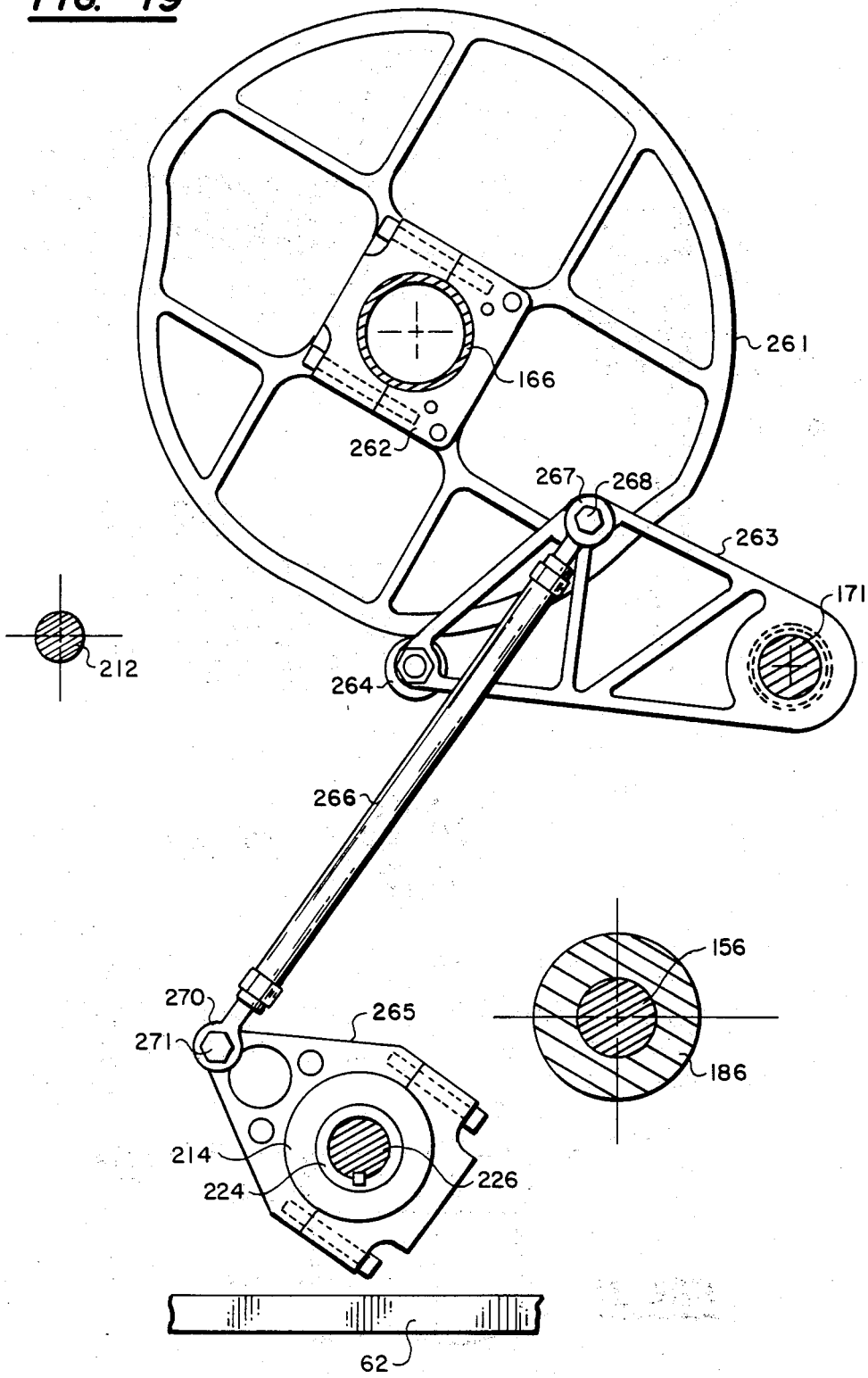

FIG. 19 is an elevational view showing the details of a cam drive for effecting oscillation of the stuffer arm.

FIG. 20 is an elevational view of the straw carrier blade in an intermediate position.

FIG. 21 is a bottom plan view of the straw carrier blade taken generally in the direction of the arrow 21 of FIG. 20.

FIG. 22 is a horizontal sectional view taken generally along the line 22—22 of FIG. 20 and shows specifically the details of the blade element.

FIG. 23 is a fragmentary vertical sectional view taken generally along the line 23—23 of FIG. 21 and shows the specific mounting of the straw carrier blade relative to shaft elements of the arm.

Figure 24:
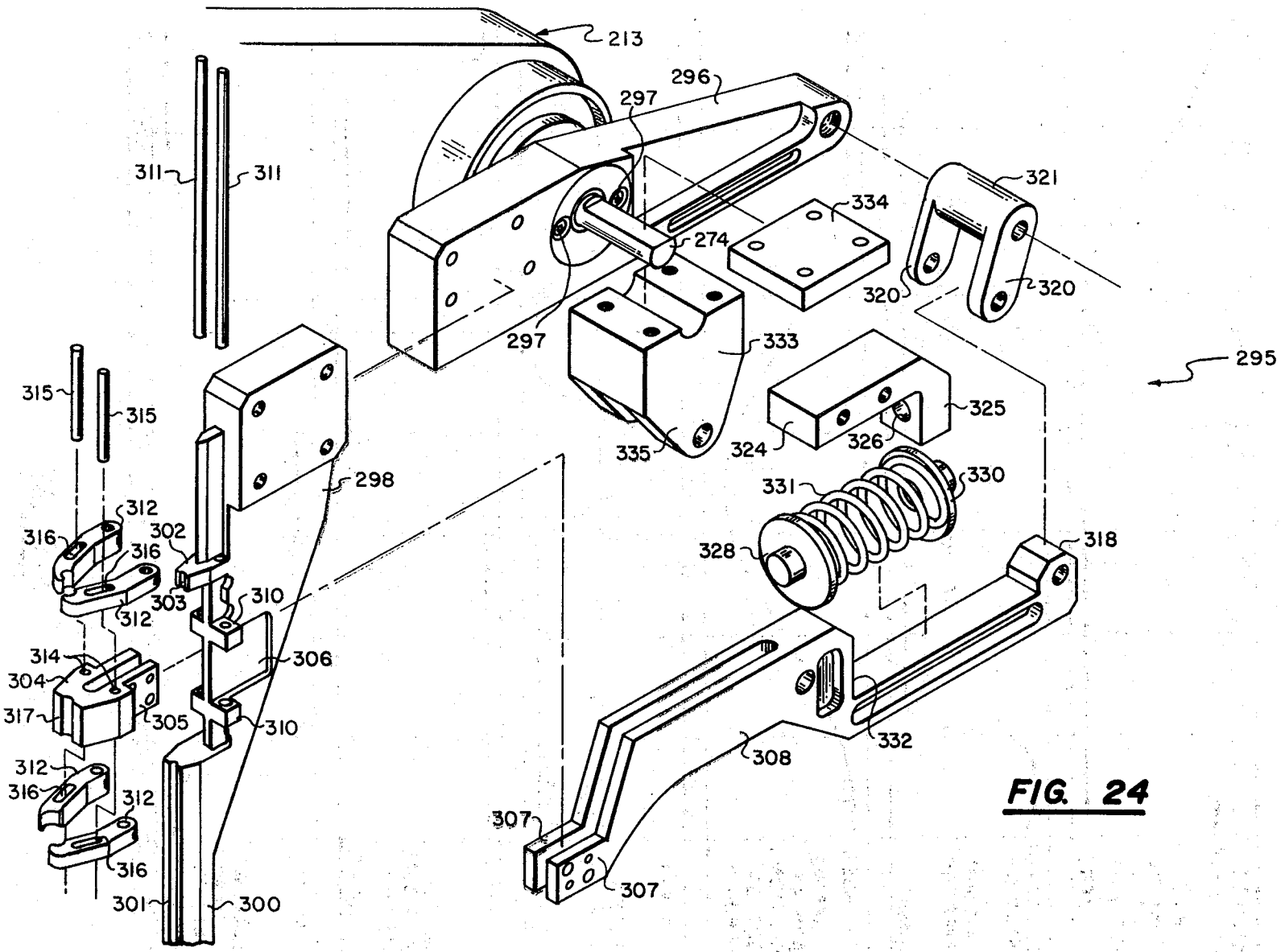

FIG. 24 is an exploded perspective view of the straw carrier blade.

Figure 25:
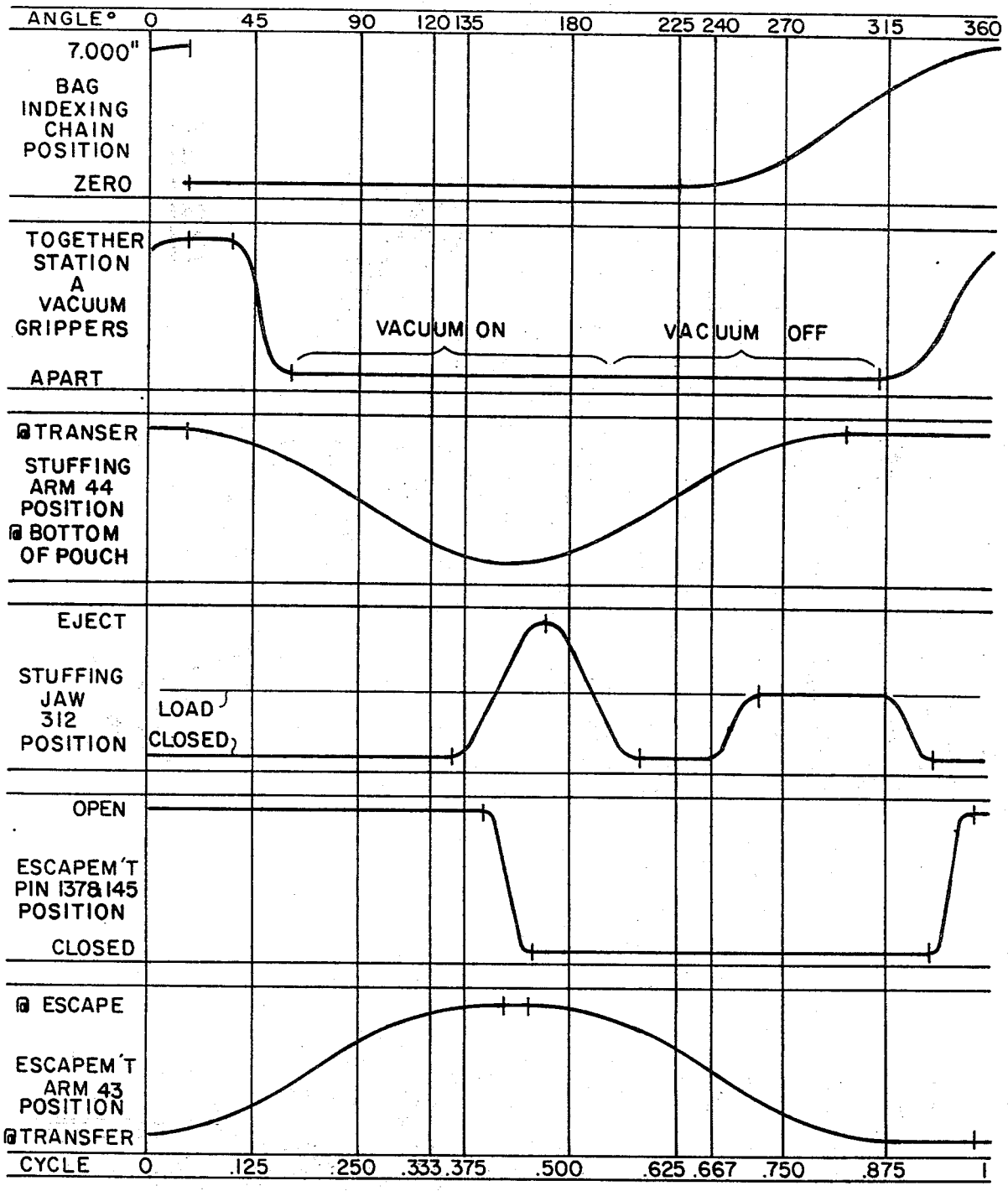

FIG. 25 is a timing diagram of various components of the apparatus.

Figure 26:
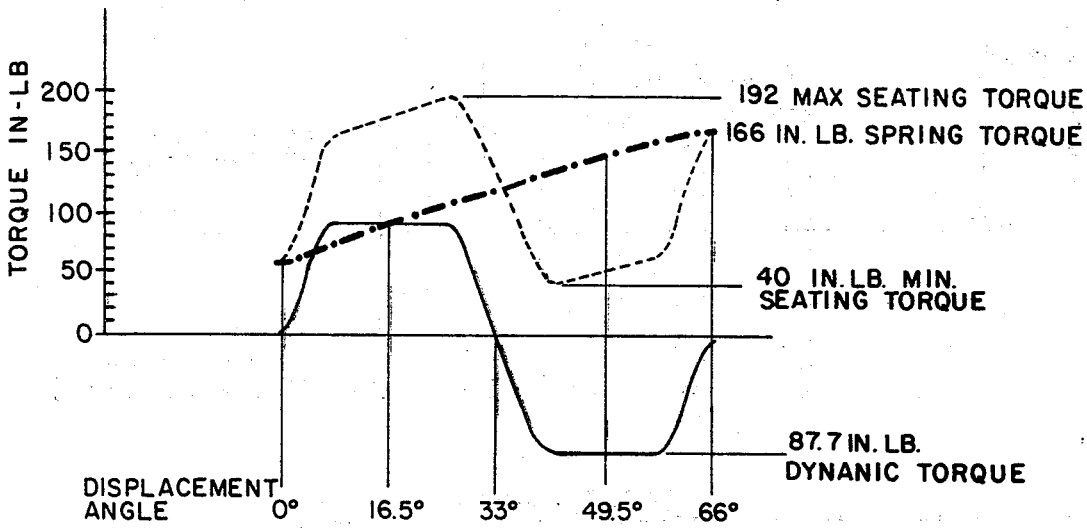

FIG. 26 is a schematic showing an analysis of the torque of the escapement arm drive mechanism.

Figure 27:
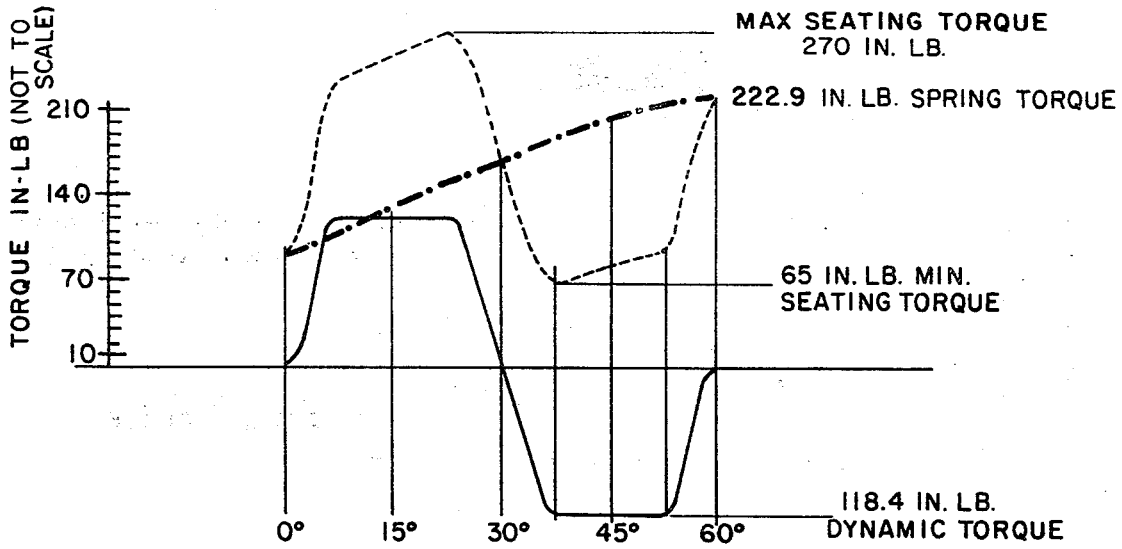

FIG. 27 is a schematic similar to FIG. 26 but being an analysis of the torque of the stuffing arm.

Figures 1, 2, 3:
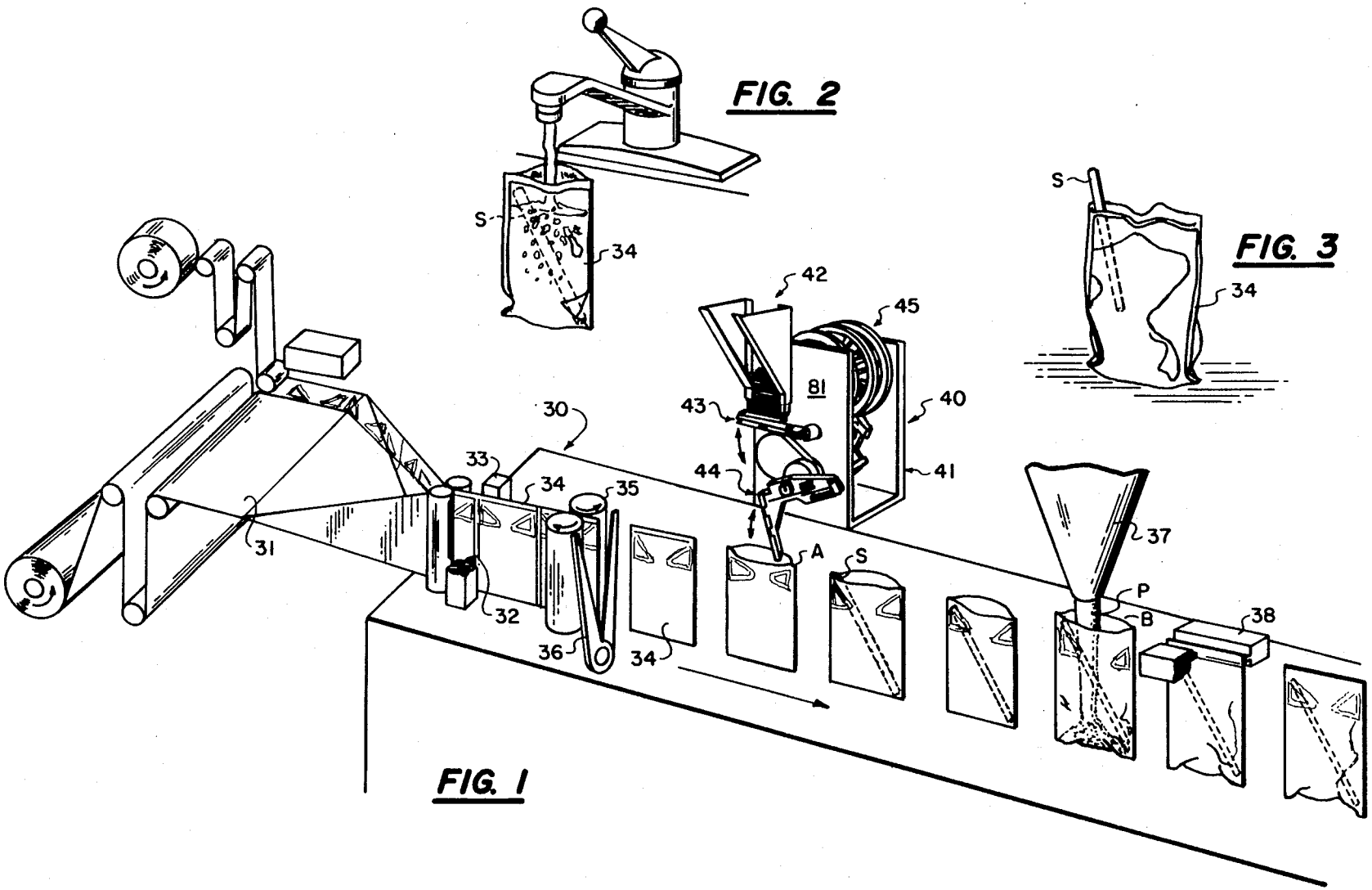
FIG. 1 is a schematic perspective view showing a conventional pouch forming and filling apparatus which has been provided with a straw stuffing apparatus in accordance with this invention.
FIG. 2 is a schematic perspective view showing a typical pouch which has been opened and which is being supplied with water for mixing with the product placed therein by the apparatus of FIG. 1.
FIG. 3 is a perspective view showing the straw partially removed from the pouch for use in drinking the product within the pouch

Referring now to the drawings in detail, it will be seen that there is illustrated in FIG. 1 a conventional Bartelt machine generally identified by the numeral 30. The Bartelt machine is so constructed so as to take a web 31 and fold the same longitudinally to define basically an upstanding folded web having its fold line lowermost and forming the bottom of the folded web. The thus folded web is transversely heat sealed as at 32 at regularly spaced intervals utilizing heat sealers 33. The heat seals 32 define individual pouches or bags 34 and are of a sufficient width so as to permit the adjacent bags to be separated one from another by means of a suitable cutting mechanism 35. Each separate pouch 34 is then engaged by a clamp type carrier 36 which is carried by an endless conveyor (not shown). It is to be understood that there will be a carrier 36 for each of the pouches 34.

The machine 30 is designed to open the pouches 34 at certain stations including a station A and a station B. In a conventional Bartelt machine there will be two fillers, one at each of the stations A and B. However, in accordance with this invention, the first filler has been omitted and there is only a filler 37 at station B. The desired product P is placed in each pouch 34 in sequence at station B. In accordance with this invention, the product P will be one which may be mixed with water and which may be drank through a straw.

After the product P has been placed in each pouch at station B, the open mouth of the pouch is closed by an upper heat sealer 38.

In accordance with this invention, there is provided at station A an apparatus for serially inserting straws into the pouches, the apparatus being generally identified by the numeral 40. As is clearly shown in FIG. 1, each straw S is placed in a pouch 34 in a diagonal position.

Although it is not part of this invention, it is to be understood that each pouch 34 is designed to be opened after which water is placed therein for mixing with the product P as is shown in FIG. 2. The straw S is partially withdrawn as shown in FIG. 3 and the product, mixed with water, is ready to be drank through the straw S.

Referring once again to FIG. 1, it will be seen that the apparatus 40 includes generally an open box-like housing 41 which carries a straw dispensing unit, generally identified by the numeral 42. The housing 41 has mounted thereon the escapement apparatus identified by the numeral 43 and the stuffer apparatus generally identified by the numeral 44. The housing carries a drive mechanism 45 for actuating the escapement mechanism 43 and the stuffer mechanism 44 in sequence.

Figure 5:
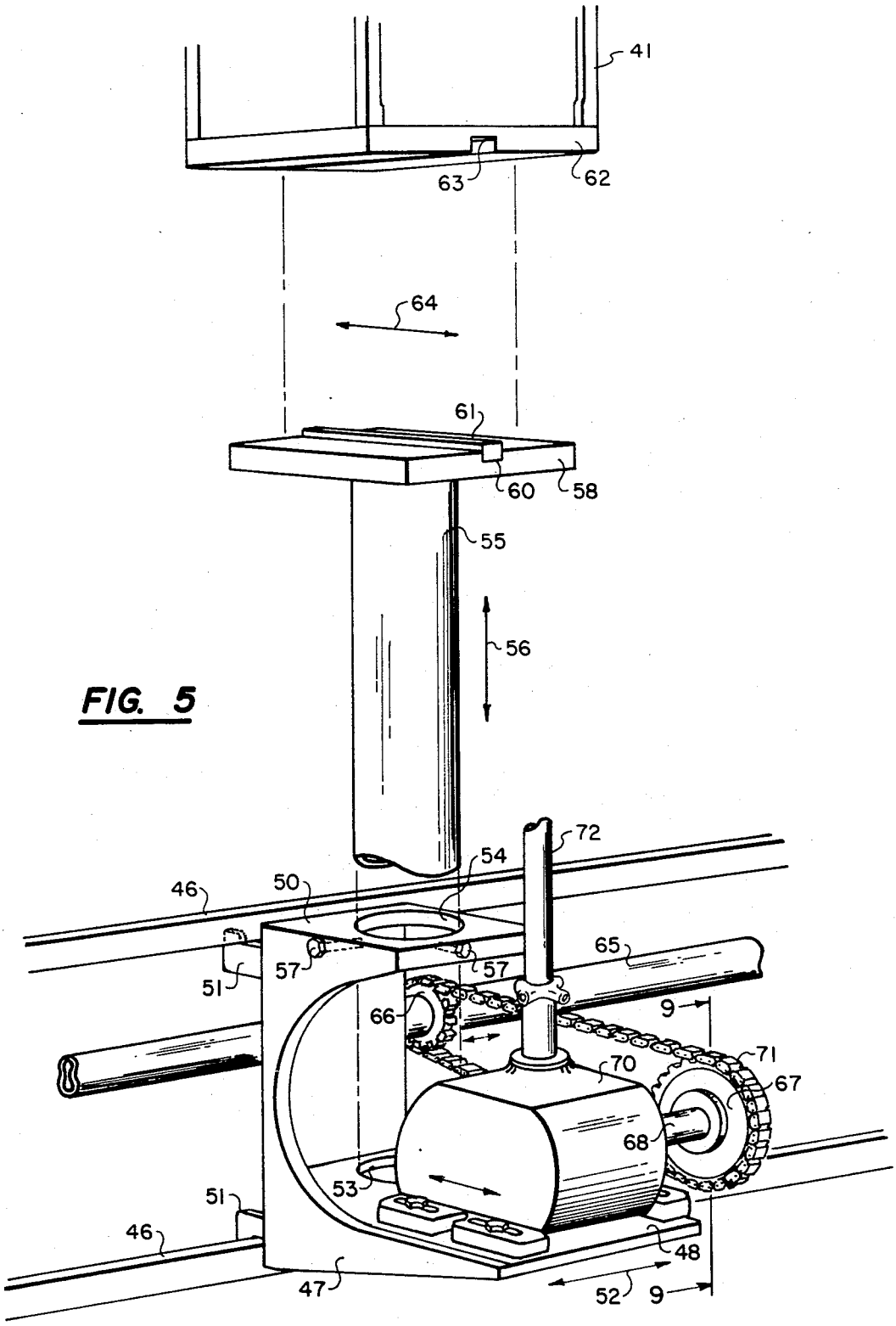
FIG. 5 is a fragmentary exploded perspective view showing the manner in which the mechanism of FIG. 4 is mounted with respect to the apparatus of FIG. 1 to be driven from a main drive shaft of the apparatus of FIG. 1 and to be adjusted relative to such apparatus.

Referring now to FIG. 5, it will be seen that the housing 41 is mounted relative to frame members 46 of the Bartelt machine 30 for transverse adjustment, longitudinal adjustment and vertical adjustment. In order to accomplish these various adjustments, there is provided a support unit 47 which includes a lower base 48 and an upper base 50. The support 47 is provided with mounting arms 51 which are secured to the frame members 46 for adjustment longitudinally of these frame members 46 so that the support may be adjusted generally in the direction of the arrow 52.

The bases 48, 50 are provided with aligned circular holes 53, 54 through which pass a tubular column 55. The column 55 is vertically adjustable relative to the base 48 in the direction of the arrow 56 and is maintained in such a vertically adjusted position by means of locking screws 57 carried by the upper base 50.

The column 55 carries at its upper end a support plate 58 which is provided with a transverse keyway in which there is seated a key 61. The housing 41 has a base 62 which is provided in its underside with a transverse keyway 63. The base 62 seats on the mounting plate 58 with the key 61 being seated in the keyway 63 so as to control adjustment of the housing 41 relative to the mounting plate 58 in a transverse direction as indicated by the arrow 64.

The Bartelt machine 30 includes a longitudinal drive shaft 65. The drive shaft 65 is provided with a longitudinally adjustable drive sprocket 66 which is aligned with a driven sprocket assembly 67 carried by an input shaft 68 of a right angle drive unit 70. The sprockets 66, 67 are interconnected by a drive chain 71. The right angle drive 70 is provided with a vertical output shaft 72 which may include splined sections.

Figure 9:
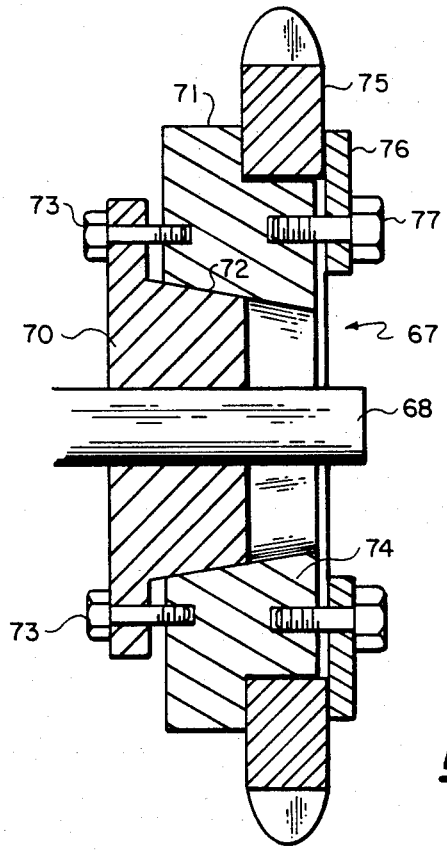
FIG. 9 is an enlarged fragmentary sectional view taken generally along the line 9—9 of FIG. 5 and shows the details of a main driven sprocket for the apparatus.

Referring now to FIG. 9, it will be seen that the driven sprocket assembly 67 includes a conventional two piece hub assembly formed by an inner hub member 70 and an outer hub member 71. The inner hub member 70 will be of a split construction and is seated in a tapered bore 72 in the outer hub member 71. The hub members 70, 71 are drawn together in internest relation by means of bolts 73 with the inner hub member clamping tightly about the shaft 68.

The outer hub member 71 has an end portion 74 of a reduced diameter over which there is telescoped a sprocket member 75. The sprocket member 75 is clamped in an adjusted position relative to the hub member 71 by means of a clamping band 76 which is secured to the hub member 71 by bolts 77. By loosening the bolts, the sprocket member 75 may be angularly adjusted relative to the shaft 68.

Figure 8:
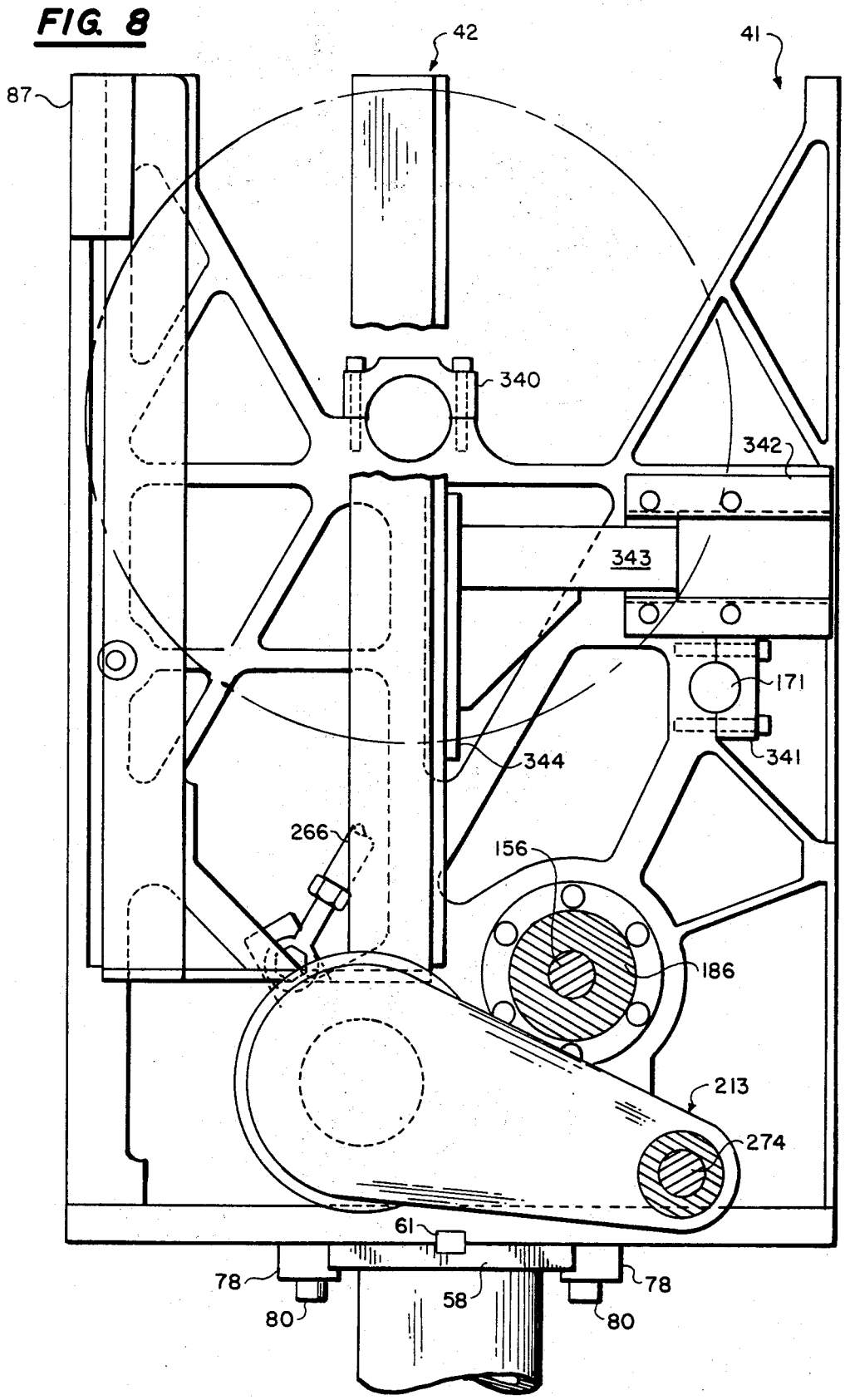
FIG. 8 is a front elevational view of the apparatus of this invention with parts broken away and shown in section and shows the relationship of the positions of the various shafts and the adjustable mounting of the straw hopper.

Reference is now made to FIG. 8 wherein it will be seen that the housing base 62 is fixedly clamped to the support plate 58 by way of clamp bars 78 secured by bolts 80 to the underside of the base 62 and in clamping relation to the support plate 58. It is to be noted that the clamp bars 78 extend transversely of the apparatus.

Figure 7:
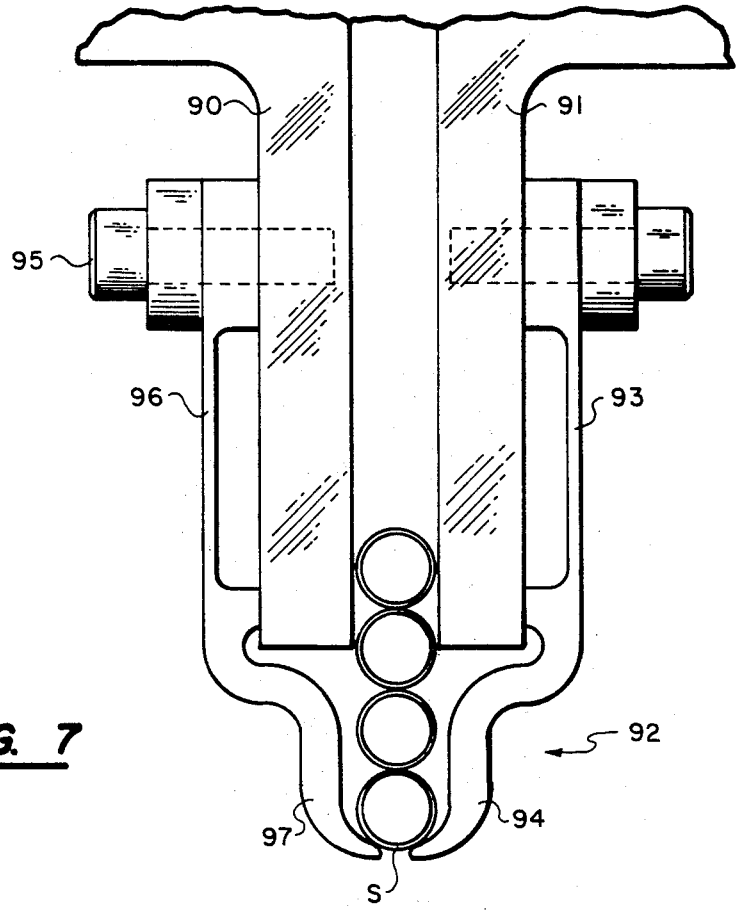
FIG. 7 is an enlarged fragmentary end elevational view of the bottom of a hopper and shows the manner in which straws are releasably retained.

Reference is now made to FIGS. 6 and 7 wherein the specific details of the straw dispenser 42 are shown. First of all, it is to be understood that the housing 41 has a front wall 81. The straw dispenser 42 is suitably mounted on the front wall 81 as is shown in FIG. 1.

As is best shown in FIGS. 1 and 6, the straw dispenser 42 includes a hopper 82 which is formed of two triangular plates 83. The plates 83 are provided with opposed rear flanges 84 and opposed front flanges 85. These flanges retain the staws S within the hopper 82.

It will be seen that the hopper 82 is spaced forwardly of the front wall 81 of the housing 41 by means of lower combined spacer and bracket 86 and an upper spacer 87.

It will also be seen that the lower part of the hopper 82 is in the form of a guideway, generally identified by the numeral 88 which includes a rear wall 90 and a front wall 91 which are spaced apart a distance equal to the diameter of the staws S to be dispensed. This is best shown in FIG. 7.

Referring particularly to FIG. 7, it will be seen that the walls 90, 91 carry a gate mechanism 92. The gate mechanism 92 includes a first spring member 93 which is removably secured to the wall 91 and which has a lower gate portion 94. The rear wall 90 has removably secured thereto by suitable fasteners 95 a second spring member 96 which carries a second lower gate portion 97 which corresponds generally to the gate portion 94. When a downwardly directed force is directed upon the lowermost straw S, the gate portions 94, 97 will move apart against the resiliency of the spring portions and will permit the dispensing of a single straw S.

Referring once again to FIG. 6, it will be seen that the straws are urged in single file between the walls 90, 91 by means of an agitator 98. The agitator 98 is in the form of a roller having a flat surface 100 and rotates in a counterclockwise direction. The flat surface 100 agitates the staws in a manner to break up straw bridging to permit a lowermost straw within the hopper 82 to enter in between the walls 90, 91.

It is to be understood that the agitator 98 is rotatably journalled in a suitable manner (not shown) within the bracket 86 and is driven by a drive belt 101 from a drive spindle 102 which is telescoped over a reduced diameter shaft end portion 103 and is secured in place by a bolt 104. It is to be noted that the shaft end portion 103 is journalled in a bearing 105 carried by the front wall 81.

Figures 11, 12:
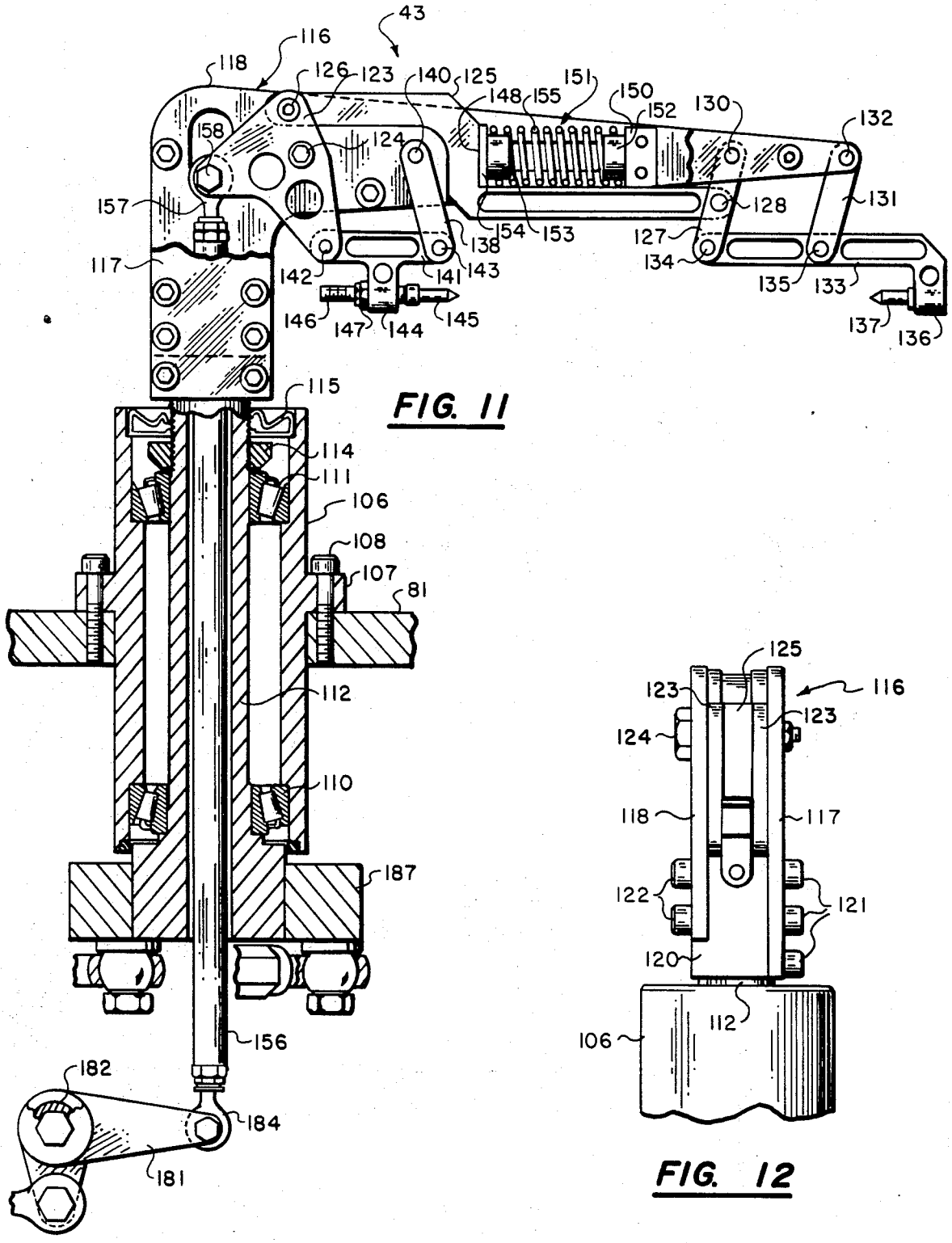
FIG. 11 is a plan view of an escapement arm assembly and shows the general details thereof.
FIG. 12 is a fragmentary elevational view of the escapement arm assembly and shows further the details thereof.

Reference is now made to FIGS. 11 and 12 wherein there are illustrated the details of the escapement arm assembly 43. First of all, it will be seen that the escapement arm assembly 43 is supported by a tubular support 106 having a mounting flange 107 secured to the front of the front wall 81 by means of bolts 108. The tubular shaft 106 carries an inner tapered roller bearing 110 and an outer tapered roller bearing 111 which support for rotation a tubular shaft 112. The shaft 112 carries a nut 114 which is threaded on the shaft 112 and engages the inner race of the bearing 111, loading it against the bearing 110. A seal 115 is mounted within the outer portion of the tubular support 106.

The shaft 112 extends forwardly out of the support 106 and has clamped thereon a generally L-shaped arm 116. As is best shown in FIG. 12, the arm 116 is formed of two members 117, 118 which are clamped to opposite faces of an adaptor 120 carried by the shaft 112. The plate 117 is secured in place by bolts 121 while the plate 118 is secured in place by bolts 122.

The plates 117, 118 have positioned therebetween generally tirangular levers 123 which are pivotally mounted on a pivot shaft 124 generally in the form of a bolt, as is best shown in FIG. 12.

One end of a generally Z-shaped link 125 is positioned between the pair of levers 123 and is pivotally connected thereto by means of a pivot 126. The opposite end of the link 125 is pivotally mounted between a pair of arms 127 by means of a pivot 128. The arms 127 are, in turn, pivotally connected to the plates 117, 118 by means of a pivot 130. A like pair of arms 131 are arranged parallel to the arms 127 and are also connected between the plates 117, 118 by way of a pivot 132.

The opposite ends of the arms 127, 131 are connected to an elongated bar 133 by way of pivots 134, 135. A remote end of the bar 133 carries an enlargement 136 which, in turn, carries a pin 137 for engagement with an end of a straw to be transferred.

Another pair of arms 138 is associated with the levers 123 and are mounted between the plates 117 and 118 by way of a pivot 140. Another bar, 141, which is aligned with the bar 133, has one end positioned between and connected to the levers 123 by means of a pivot 142. The opposite end of the bar 141 is positioned between and pivotally connected to the arms 138 by means of a pivot 143.

The bar 141 is provided centrally thereof with a projecting enlargement 144 which, in turn, carries a pin 145 which is axially aligned with and opposes the pin 137. It is to be understood that the pin 145 is provided with an elongated threaded shank 146 which is threadedly engaged within the projection 144 for adjustment towards and away from the pin 137 so as to be adjusted to accommodate straws of different lengths. The pin 145 is locked in an adjusted position by means of a lock nut 147.

At this time it is pointed out that the generally Z-shaped configuration of the link 125 provides a shoulder 148 which opposes a stop block 150 mounted between the plates 117, 118 and fixedly secured thereto. Between the shoulder 148 and the stop block 150 is a spring assembly generally identified by the numeral 151. The spring assembly 151 includes a centering member 152 carried by the stop block and a further centering member 153 having a mounting plate 154 which engages the shoulder 148. A compression coil spring 155 extends between the stop block 150 and the plate 154.

It will be readily apparent that the spring 155 serves to urge the link 125 to the left, thereby urging the levers 123 in a counterclockwise direction which, in turn, serves to draw the pins 137, 145 together.

In order to effect separation of the pins 137, 145 so that a straw S may be selectively engaged and released, there is provided an actuating rod 156 which extends from within the housing 141 through the tubular shaft 112 and through the adaptor 120 into the space between the plates 117, 118. The outer end of the rod 156 is provided with a customary rod end 157 which carries a pivot 158 which positions the rod end 157 between the levers 123 and pivotally connects the same thereto.

It will be readily apparent from FIG. 11 that when the rod 156 is projected outwardly, it will pivot the levers 123 in a clockwise direction, moving the bar 141 and the pin 145 to the left while at the same time moving the link 125 to the right, moving the bar 133 and the pin 137 to the right. It is to be understood that the pins 137, 145 will be separated sufficiently to clear a straw S and thus release the straw.

Referring now to FIG. 10, it will be seen that the housing 41 includes a rear wall 160 which has mounted on the rear surface thereof a spacer 161 to which there is secured a right angle drive 162. The right angle drive 162 has an input shaft 163 to which there is connected the upper end of the drive shaft 72 by means of a universal joint 164. The right angle drive 162 also includes an output shaft 165.

It will be seen that the output shaft 165 is axially aligned with a tubular drive shaft 166 of which the reduced end portion 103 is a part. The end of the tubular drive shaft 166 opposite the reduced end portion 103 is connected to the output shaft 165 by means of a flexible coupling 167.

The drive shaft 166 has clamped thereon in an adjusted position adjacent the rear wall 160 a cam 168. The cam 168, as is best shown in FIG. 13, is provided with a split clamping hub assembly 170 which faciliates the clamping thereof onto the drive shaft 166 and the rotational adjustment of the cam 168 with respect to the drive shaft 166.

A rocker arm shaft 171 extends between the front wall 81 and the rear wall 160 and is rigidly clamped thereto. The rocker shaft 171 has rotatably journalled thereon a rocker arm or lever 173 which carries a cam follower 174 that is engaged with the surface of the cam 168. The rocker arm 173 has a pivot pin 175 which pivotally connects a rod end 176 of a rod-like link 177 to the rocker arm 173. The opposite end of the link 177 carries another rod end 178 which is connected by means of a pivot 180 to a crank 181 which is carried by a pivot 182 carried by a bracket 183 extending forwardly from the rear wall 160.

The opposite end of the crank 181 is connected to a rod end 184 of the rod 156 by means of a pivot 185.

From the foregoing, it will be seen that the cam 168, through the rocker arm 173, the link 177 and the crank 181 serves to reciprocate the rod 156 to open and close the pins 137, 145.

Figure 15:
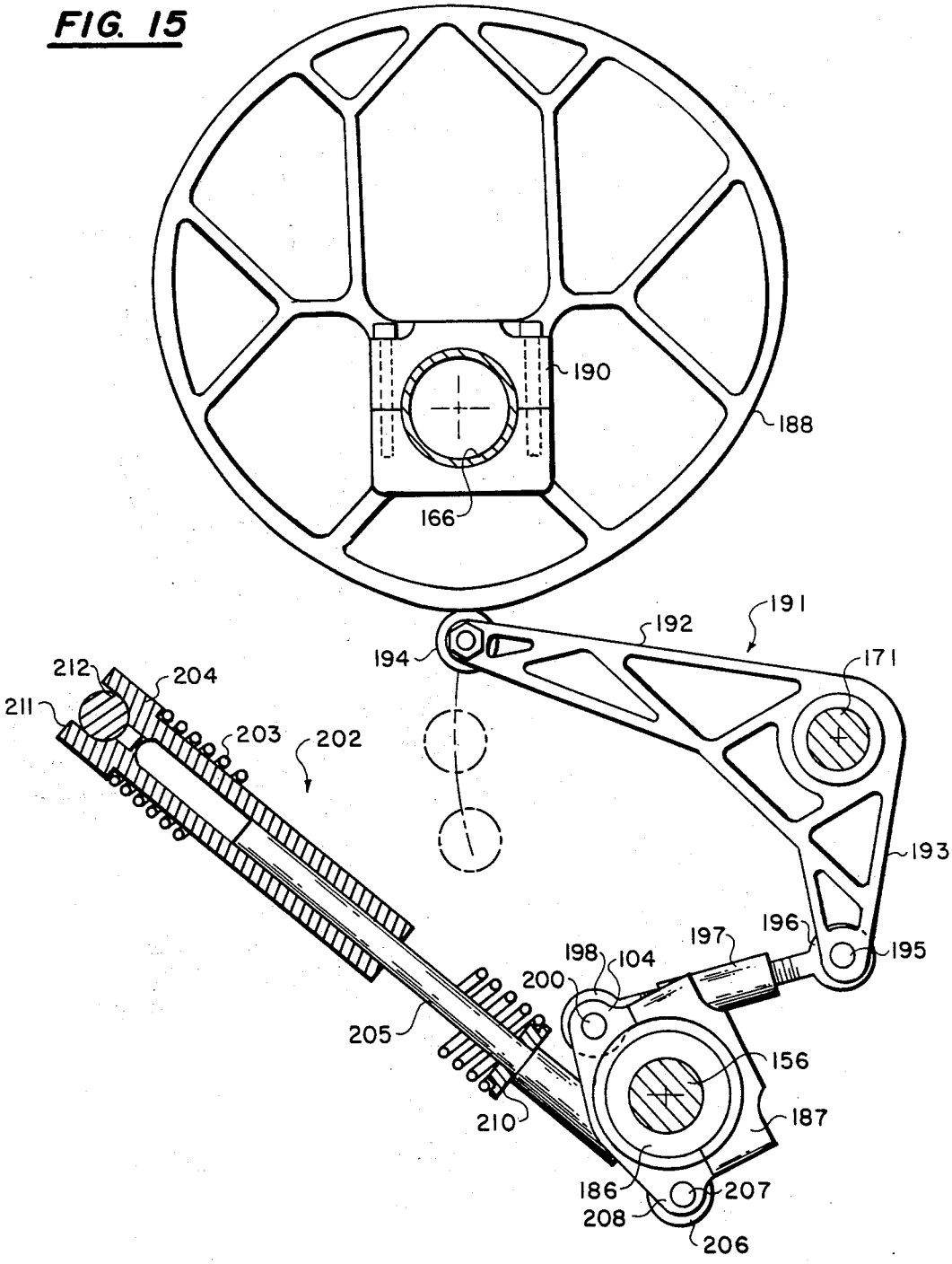
FIG. 15 is an elevational view with parts broken away and shown in section of a cam drive for effecting oscillation of a support shaft for the escapement arm assembly.

As is clearly shown in FIGS. 11 and 14, the tubular shaft 112 is provided with an enlarged end 186. The enlarged end 186 is provided with a split crank member 187 as is best shown in FIG. 15. The crank 187 is actuated by means of a cam 188 having a split hub 190 which is adjustably clamped on the drive shaft 166 to adjust the rotational and linear position of the cam 188 with respect to the drive shaft 166.

The rocker shaft 171 has rotatably journalled thereon an angular rocker arm 191 which includes arms 192 and 193. The arm 192 carries a cam follower 194 which engages a cam 188. The arm 193 carries a pivot 195 which secures to the arm 193 a rod end 196 of a rod-like link 197. The opposite end of the rod-like link 197 is provided with a rod end 198 which through a pivot pin 200 is connected to an ear 201 of the crank 187 so as to oscillate the shaft 112 in response to the rotation of the cam 188.

In order that the cam follower 194 may be in constant engagement with the cam 188 and also to generally counterbalance the escapement arm assembly 43, there is associated with the crank 187 a spring unit 202. The spring unit 202 includes a coil compression spring 203 which has engaged in one end thereof a fitment 204 which is tubular and has slidably engaged therein the end of a rod 205. The rod 205 is provided with a rod end 206 which is connected by way of a pivot 207 to a second ear 208 of the crank 187.

The rod 205 carries a combined centering and stop member 210 which engages one end of the spring 203. The fitment 204 which engages the opposite end of the spring 203 is positioned axially of the spring 203 and the rod 205 by having a bifurcated end portion 211 thereof engaged with a positioning shaft 212 which extends between and is positioned by the front wall 81 and the rear wall 160 of the housing 41.

Figure 4:
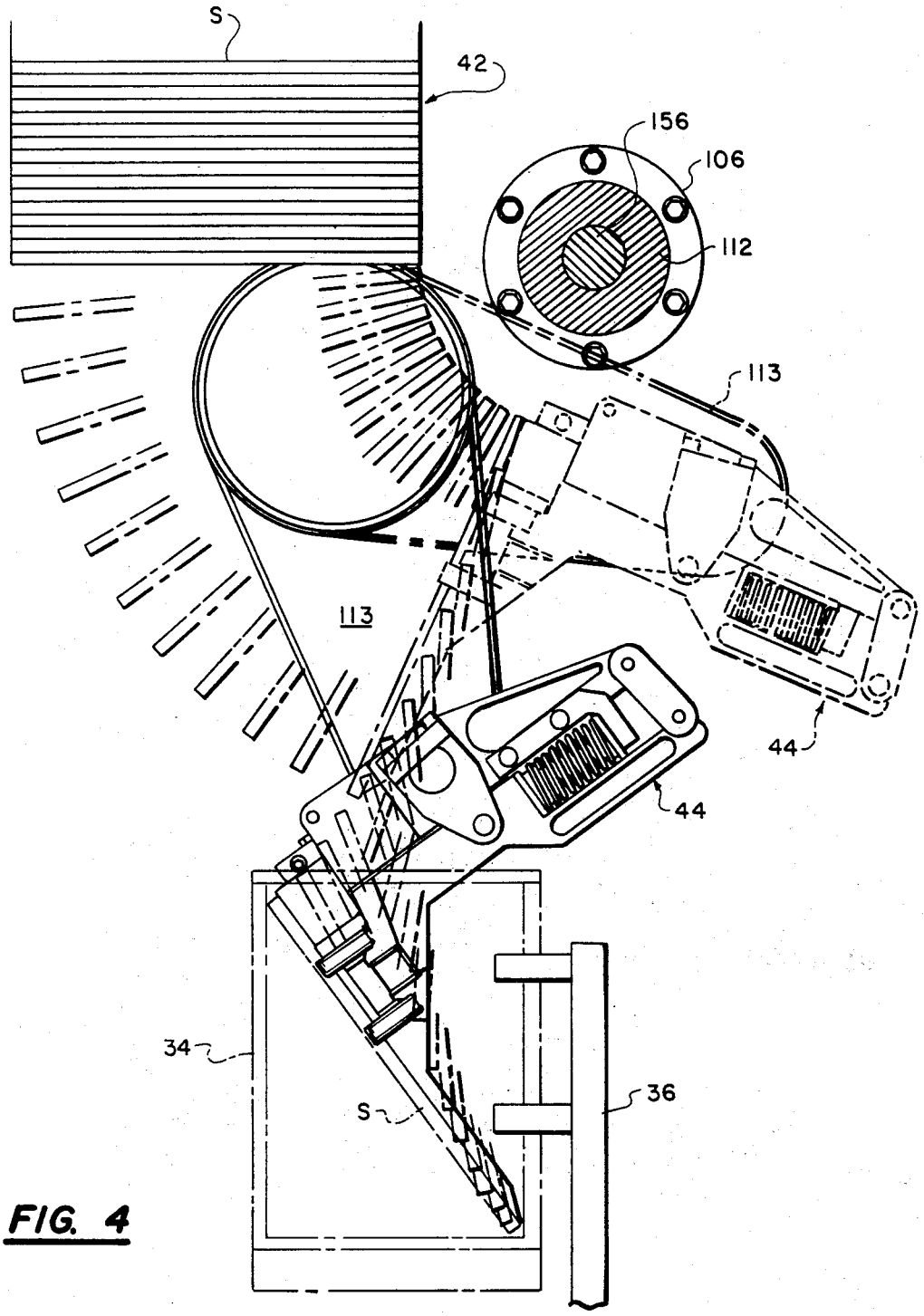
FIG. 4 is a schematic elevational view showing diagrammatically how a straw is removed from a straw supply and rotated to an intermediate location where it is picked up by a straw stuffer and placed within an open pouch.

With reference to FIGS. 1 and 4, it will be seen that the normal position of the escapement arm assembly 43 is in a position below the straw dispenser 42 for engaging and receiving a straw therefrom. The cam 188 as the drive shaft 166 rotates, serves to oscillate the escapement arm assembly 43 from that position to a position sloping downwardly generally on the order of 200° as is specifically shown in FIG. 4. At this point the escapement arm assembly is momentarily stationary while the straw is being transferred to the assembly 44.

At this time it is to be noted that the cam 168 is so configurated so as to separate the pins 137, 145 when the escapement arm assembly reaches this latter position and the pins remain spaced apart until the escapement arm assembly returns to its position adjacent the bottom of the straw dispenser 42.

Figure 16:
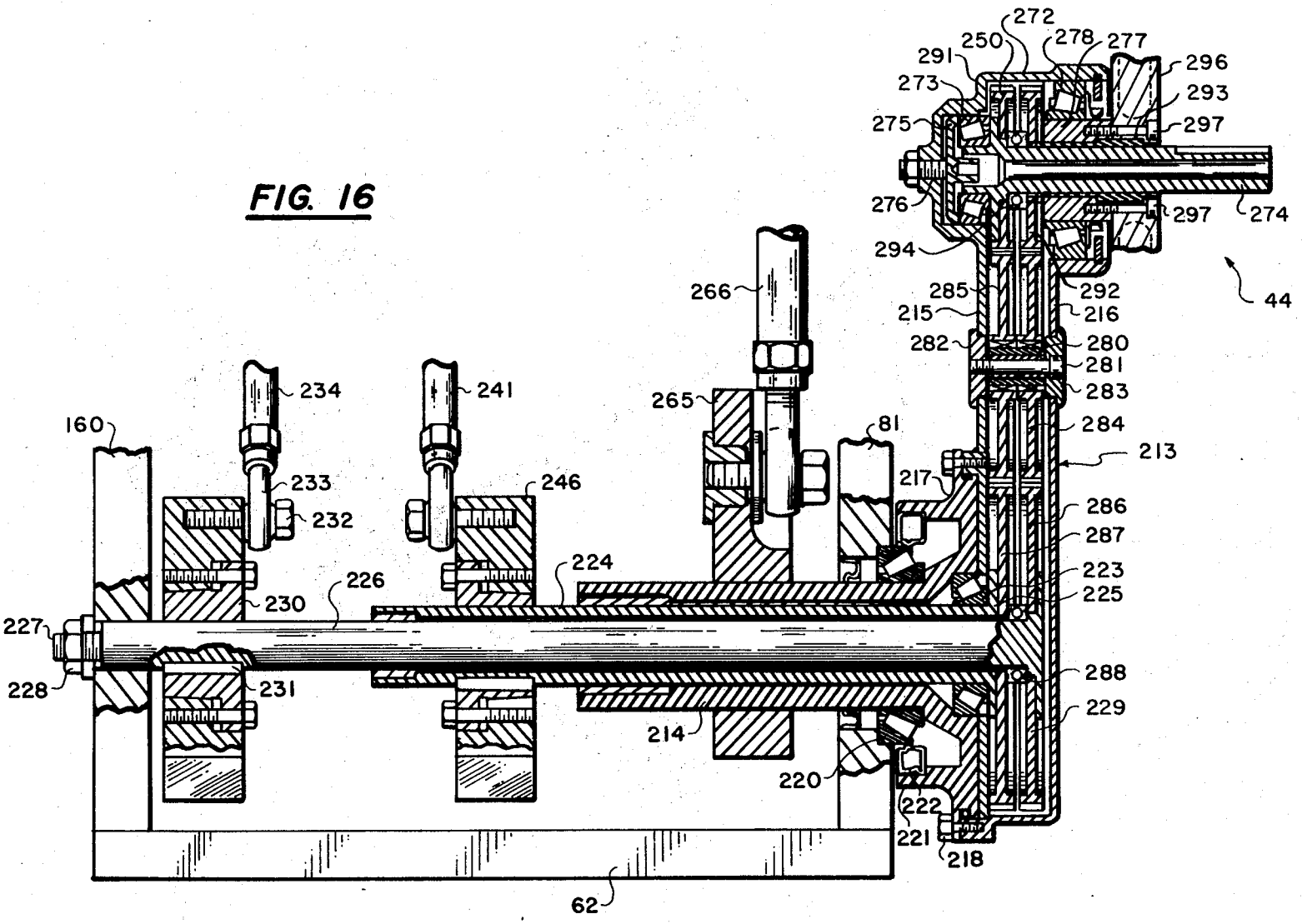
FIG. 16 is a horizontal sectional view taken through the lower portion of the drive mechanism of FIG. 10 and shows specifically the drive mechanism for the stuffer arm assembly.

Reference is now made to FIG. 16 wherein there is illustrated the details of the drive for the stuffing arm assembly 44. It will be seen that the drive includes an arm 213 which is carried by a tubular shaft 214 which extends through the front wall 81. The arm 213 is in the form of a hollow casing and includes a rear casing member 215 and a front casing member 216 which are suitably joined together. The shaft 214 is provided with a mounting flange 217 which is secured to the rear casing half 215 by bolts 218.

The tubular shaft 214 is rotatably journalled relative to the front wall 81 by means of a tapered roller bearing 220. The flange 217 has projecting therefrom concentric with the shaft 214 a tubular portion 221 which carries the seal 222 that enages the fixed outer bearing race of the bearing 220 which is seated relative to the front wall 81.

The flange 217 also carries an outer tapered roller bearing 223 in which there is journalled an outer end of an intermediate tubular shaft 224. The outer end of the shaft 224 is provided with a mounting flange 225 to be described in detail hereinafter.

Finally, there is an innermost shaft 226 which has the right portion thereof journalled within the shaft 224 and the left end thereof fixed in the rear wall 160 and secured in place by means of a threaded end portion 227 and a nut 228. The right end of the shaft 226 is provided with a mounting flange 229.

At this time it is also pointed out that the intermediate tubular shaft 224 is rotatably journalled within the outer tubular shaft 214.

Although the shaft 226 is fixed, it is rotationally adjustable. Accordingly, the shaft is provided with a crank 230 which is fixedly secured to the shaft 226 by means of a key 231. The crank 230 has connected thereto by means of a pivot 232 a rod end 233 of a link 234. As is best shown in FIG. 17, the opposite end of the link 234 is also provided with a rod end 235 which is secured by means of a pivot 236 to the bracket 183.

It is to be understood that the link 234 is in the form of a turnbuckle so that the length of the link 234 may be adjusted, thereby changing the angular position of the shaft 226.

Reference is now made to FIG. 18 wherein there is illustrated the drive for oscillating the shaft 224. The drive includes a cam 237 which is rotationally adjustably mounted on the drive shaft 166 by means of a split hub 238.

A rock arm 240 is pivotally mounted on the rocker shaft 171 and carries a cam follower 242 which engages the cam 237. The rocker arm 240 has connected thereto a link 241 which is provided at one end with a rod end 243 which is connected to the link 241 by means of a pivot 244. The opposite end of the link 241 is provided with a rod end 245 which is connected to a crank 246 by means of a pivot 247. It is to be noted that the crank 246 has an arm 248 which is provided with a slot 250 in which the pivot 247 is adjustably mounted to vary the angle of repose of a straw.

It is also to be noted that the crank 246 is of the split type and is clamped onto the shaft 224 in a rotationally adjusted position.

The crank 246 is provided with a second arm 251 which carries a pivot 252 securing to the crank 246 a rod end 253 which is carried by an enlarged portion 254 of a rod or pin 255. The rod 255 carries adjacent the enlarged end 254 a guide washer 256 which is engaged in one end of a compression coil spring 257.

A tubular guide member 258 is positioned in the opposite end of a spring 257 and has slidably received therein the rod 255. The guide member 258 has an enlarged end 260 which is bifurcated so as to engage the shaft 212. It is to be understood that the spring 257 serves to counterbalance a blade unit of the stuffing arm assembly which will be described hereinafter and to reduce the force re-required to effect oscillation thereof. The spring 257 also holds the cam follower 242 in engagement with the cam 237.

Reference is now made to FIG. 19 wherein there is illustrated the drive for oscillating the shaft 214. The drive means includes a cam 261 having a split hub 262 which is utilized to adjustably mount the cam on the drive shaft 166. The drive means for oscillating the shaft 214 also includes a rocker arm 263 which is pivotably mounted on the rocker shaft 171 and which carries a cam follower 264 which engages the cam 261.

The shaft 214 has adjustably mounted thereon a split crank 265. A link 266 extends between the rocker arm 263 and the crank 265. One end of the link 266 is provided with a rod end 267 which is connected to the rocker arm 263 by means of a pivot 268. A similar rod end 270 is at the opposite end of the link 266 and is pivotally connected to the crank 265 by way of a pivot 271.

As will be apparent from FIG. 16, when the shaft 214 is oscillated, the arm 213 will oscillate. The end of the arm 213 remote from the shaft 214 is provided with an enlargement 272 in which there is rotatably journalled by means of a tapered roller bearing 273 an inboard end of a shaft 274. The outer race of the bearing 273 is retained in place by an adjustable backing plate 275 carried by a threaded adjustment member 276.

The enlargement 272 also has an enlarged outboard shaft 277 which is rotatably journalled in a tapered roller bearing 278. The shaft 277 is concentric with the shaft 274.

The arm 213 has intermediate it ends a shaft 280 which is mounted on a bolt 281 extending between a pair of plates 282, 283. A pair of gears 284, 285 are journalled on the shaft 280 by means of suitable bearings 284, 285 and mesh with gears 286, 287 which are secured to the shafts 226, 224, respectively. The gears 286, 287 are spaced by means of a suitable spacer 288.

A gear 290 is mounted on a flange 291 of the shaft 274 and is meshed with the gear 285. A further gear 292 is meshed with the gear 284 and is carried by a sleeve 293 which in turn is suitably secured to the shaft 277. A spacer 294 separates the gears 290, 292.

It will be seen that since the shaft 226 is fixed, when the arm 213 oscillates, the shaft 277 is rotated. In a like manner, when the shaft 224 is fixed, the shaft 274 rotates. However, the shafts 274, 277 will normally rotate in unison. On the other hand, when the shaft 224 is independdently rotated, the shaft 274 will additionally rotate for a purpose to be described in detail hereinafter.

Reference is now made to FIGS. 20–24 wherein there are illustrated the details of the straw carrier blade assembly which is identified by the numeral 295. The assembly 295 includes an arm 296 which has a central portion thereof which is secured to the end of the shaft 277 by a plurality of bolts and drive pins of which only two bolts 297 are specifically illustrated. It is to be noted that the shaft 274 projects beyond the arm 296.

The arm 296 has fixedly secured thereto at the left end thereof as viewed in FIG. 24 a depending blade 298. The blade 298 is configurated to define a lower straw support 300 which has a grooved face 301. The blade 298 is also provided with an intermediate straw support 302 having a grooved face 303.

Intermediate the straw supports 300, 302 there is a further straw support 304 which has a bifurcated rear portion 305 which is telescoped over a thin intermediate portion 306 of the blade 298. The rear portion 305 is fixedly secured to a pair of arms 307 of a generally Z-shaped link 308 which will be described in more detail hereinafter.

Above and below the thin portion 306, the blade 298 is provided with projections 310 on each side thereof. The projections 310 receive elongated rod-like pins 311 which also pass through the straw support 302. The pins 311 which serve as pivots for clamp members 312 are disposed above and below the member 304. The member 304 is provided with bores 314 therethrough which carry pins 315 which pass through elongated slots 316 in the jaw members 312. It will thus be seen that when the link 308 moves to the right, because of the effected taper of the slots 316, the jaw members 312 of each pair will be moved apart while when the link 308 is in its left-hand position it will cause the jaw members 312 to move together to clamp a straw.

At this time it is also pointed out that the member 304 has a grooved straw engaging face 317.

At the right end thereof the link 308 is provided with a projection 318 which extends between legs 320 of a bifurcated link 321. The link 321 is pivotally mounted on the right end of the arm 296 by means of a pivot 322. The projection 318 carries a pivot 323 which extends through end portions of the legs 320.

The right portion of the arm 296 has an L-shaped bracket 324 suitably secured thereto. The bracket 324 has a vertical leg 325 with a bore 326 extending therethrough. A rod 327 (FIG. 20) is carried by an intermediate portion of the link 308 and extends through a pair of mushroom-shaped spring retainers 328,330 which have positioned therebetween a compression coil spring 331. The retainer 328 engages an abutment shoulder 332 of the link 308 while the retainer 330 engages in the bore 320.

Finally, there is a crank 333 which is carried by the shaft 274 and is clamped thereonto by means of a clamp plate 334. The crank 333 has a bifurcated lower portion 335 which is engaged over an intermediate portion of the length 308 and is pivotally connected thereto by means of a pivot 336.

It will be seen that the spring 331 normally urges the link 308 to the left to a position wherein the jaw members are open. However, when the shaft 274 turns relative to the arm 296 to move the link 308 to the right, the member 304 will move to the right and cause the jaw member 312 to move together for the purpose of gripping a tubular member such as a straw.

At this time, it is pointed out that all of the components of the mechanism are skeletonized wherever possible so as to reduce the weight of the various components to thereby reduce the dynamic torque of the parts. This is also true of the housing 41 as is best shown in FIG. 8.

At this time reference is made to FIG. 6 wherein it will be seen that the Bartelt machine 30 is provided at station A with vacuum grippers 337 which engage opposite faces of a pouch 34 positioned at station A for the purpose of opening the same. With the pouch 34 in its open state, a straw S may be placed in the pouch 34 by the stuffing arm assembly 44. At this time it is particularly pointed out that the drive shaft 166 is driven in unison with an indexing chain (not shown) carrying the clips or holders 36. It is also to be understood that the vacuum for the suction cups 337 will operate in timed relation to the rotation of the drive shaft 166.

Reference is now made to FIG. 8 wherein it will be seen that the front wall 81 is skeletonized. The same is true of the rear wall of the housing 41. It is to be noted that the front wall 81 has in the upper part thereof a split construction 340 to facilitate the mounting of the drive shaft 166. Also, in the central right portion the wall 81 is of a split construction 341 to receive the rock shaft 171.

It will also be noted that the front wall 81 is provided with a mounting bracket 342 which has adjustably mounted therein a support arm 343 carried by a plate 344 secured to the right side of the straw dispenser 42.

Referring now to FIG. 25, it will be seen that there is illustrated the timing of the various components of the Bartelt machine and the straw stuffing apparatus is shown. As previously described, when the bag or pouch 34 is in a fixed position at station A, the stuffing arm assembly will move so as to position a straw within the open mouth of such bag and will release the straw therein. The timing of the apparatus is such that a lowermost straw is received by the escapement pins and the escapement arm, which after the pins are closed, will move the straw to a position where it will be transferred from the escapement pins to the stuffing arm and that the stuffing jaws are opened to receive a straw from the escapement arm at the time the escapement pins present a straw to the stuffing jaws after which the stuffing jaws close and the escapement pins open to release the straw, and when the stuffing arm has placed the straw within the pouch or bag 34, the stuffing jaws open more widely so as to release the straw.

Most particularly, with further reference to FIG. 25, it will be seen that at the beginning of the cycle the escapement pins 137, 145 are open and the escapement arm assembly 43 is generally at the position where transfer of a straw to the stuffer arm assembly 44 has been effected. As the escapement arm assembly 43 returns towards the straw dispensing unit 42 the stuffing arm assembly 44 moves towards an adjacent pouch 34. As the blade 298 begins to enter into the pouch 34, the jaw members 312 begin to open. Shortly thereafter the escapement pins 137, 145 begin to close to engage the lowermost straw ready to be dispensed.

It will be seen that the escapement pins 137, 145 close to receive a straw at a time when the escapement arm assembly 43 is stationary and at a time before the previously dispensed straw is fully placed within the pouch 34.

It is also to be noted that the actuation of the link 308 during the dispensing of a straw is not only sufficient to open the jaw members 312, but also to move the straw support 304 outwardly beyond the other supports for the straw so as to assure the displacement of a straw beyond the grasp of the clamp members 312.

Then as the escapement arm assembly 43 begins to move away from the straw dispensing unit 42 after the escapement pins 137, 145 have closed, the jaw members 312 begin to close as the stuffing arm assembly begins to move the blade 298 out of the pouch which has just received a straw.

As the stuffing arm assembly 44 approaches the escapement arm assembly 43, the jaw members 312 again open, but the link 308 only moves at this time sufficiently to open the jaw members 312 to receive a straw.

When the escapement arm assembly 43 and the stuffing arm assembly reach the straw transfer point, the pouch in which a straw was previously presented has already began to advance and the vacuum for the suction cups 337 is turned off.

Finally, when the escapement arm assembly 43 and the stuffing arm assembly 44 reach the transfer point, the jaw members 312 close about a straw carried by the escapement arm assembly and immediately thereafter the escapement pins 137, 145 move apart to release the transferred straw.

The cycle begins anew as is clearly shown in FIG. 25.

Reference is now made to FIGS. 26 and 27. First of all, it is to be understood that the escapement arm assembly 43 and the stuffing arm assembly 44 are made as light as possible by skeletonizing the various parts. This is also true of the various elements for these two assemblies. This permits the torque of the springs 203 and 257 to be as small as possible.

It is also to be understood that when the displacement angle for the escapement arm assembly 43 is at its position of maximum displacement angle and the torque of the spring 203 is the greatest, the stuffing arm assembly 44 is still at its zero displacement position. Then as the escapement arm assembly 44 begins to move and compression of the spring 257 begins, it will be seen that the compression of the spring 203 reduces and thus when the stuffing arm assembly 44 reaches its maximum displacement angle of 60°, the escapement arm assembly 43 has substantially moved back to its zero position. It will thus be seen that as the spring 257 is compressed, the compression of the spring 203 is gradually reduced so that when the spring 257 reaches its maximum torque condition the torque of the spring 203 approaches its minimum. In this manner, the springs 203, 257 counterbalance each other. It should be apparent from the illustrations of FIGS. 26 and 27.

Although only a preferred embodiment of the various mechanisms of the invention has been specifically illustrated and described and the environment is that of inserting straws into pouches, it is to be understood that the various mechanisms may be utilized individually in other embodiments and minor variations may be made therein without departing from the spirit and scope of the invention as defined by the appended claims.

I claim:

1. An apparatus for serially inserting straws into pouches, said apparatus comprising a straw dispenser for presenting straws one at a time, an escapement means including means for picking a presented straw and moving such straw in a swinging movement in a first direction from said straw dispenser generally towards a pouch position, and stuffer means for receiving such displaced straw from said escapement means remote from said straw dispenser and including means for moving such straw in a swinging movement in a second direction into a pouch located at said pouch position.

2. Apparatus according to claim 1 wherein a presented straw lies generally in a horizontal position and a stuffed straw lies in an upright position.

3. Apparatus according to claim 1 wherein a presented straw lies generally in a horizontal position and a stuffed straw lies in an upright position tilted under the control of said stuffer means to a position to and then beyond the vertical.

4. Apparatus according to claim 1 wherein said escapement means swings about a first fixed axis when moving in said first direction, and said stuffer means swings about a second fixed axis while such straw is additionally being rotated generally about an axis generally normal to the longitudinal axis of such straw.

5. Apparatus according to claim 1 wherein said escapement means includes an escapement arm carrying a pair of opposed escapement pins, and means carried by said escapement arm for moving said escapement pins together to enter into opposite ends of a straw to engage a straw and for moving said escapement pins apart to release a grasped straw.

6. Apparatus according to claim 5 wherein said escapement arm is generally L-shaped in outline and includes first and second legs, said first leg having a shaft extending therefrom as an axial extension thereof, means mounting said shaft for rotation about the shaft axis, and means for oscillating said shaft to rock said second leg about said shaft axis.

7. Apparatus according to claim 6 wherein said escapement pins are carried by said second leg, and said means for moving said escapement pins includes an actuator rod extending axially through said shaft and said first leg, and there being means for reciprocating said actuator rod in timed relation to oscillation of said shaft.

8. Apparatus according to claim 1 wherein said stuffer means includes an arm, a first shaft secured to said arm adjacent a first end of said arm and mounting said arm for oscillation about a fixed axis, a second shaft carried by said arm adjacent a second end of said arm and projecting from said arm, a straw carrier blade carried by said second shaft for swinging movement relative to said arm, clamp means associated with said blade, and drive means mounted within said arm for swinging said blade to pivot said blade relative to said arm and thus position a straw in a pouch and for opening and closing said clamp means in timed relation to swinging of said blade.

9. Apparatus according to claim 8 wherein there is a third shaft coaxial with said second shaft and being rockable relative to said blade to open and close said clamp means.

10. Apparatus according to claim 9 together with fourth and fifth shafts arranged coaxially with said first shaft, and said drive means connecting said second shaft to said fourth shaft and said third shaft to said fifth shaft.

11. Apparatus according to claim 10 wherein said drive means include two separate gear trains.

12. Apparatus according to claim 10 wherein said first and fourth shafts are driven by separate cam drives, and said fifth shaft is fixed against rotation.

13. Apparatus according to claim 12 wherein said escapement means includes an escapement arm carrying a pair of opposed escapement pins, and means carried by said escapement arm for moving said escapement pins together to enter into an end of a straw to engage a straw and for moving said escapement pins apart to release a grasped straw, said means for moving said escapement pins including a cam drive, and there being a further cam drive for moving said escapement means in said first direction and return.

14. Apparatus according to claim 13 wherein each of said cam drives includes a cam carried by a common drive shaft, and rock arms mounted on a common rock shaft, each rock arm carrying a cam follower engaged with a respective one of said cams, and a link extending from a respective rock arm.

15. Apparatus according to claim 1 wherein there is a common drive shaft for said escapement means and said stuffer means, separate cam means carried by said common drive shaft for each of said escapement means and said stuffer means, each of said cam means including a cam carried by said common drive shaft, a rock arm, a cam follower carried by said rock arm and engaging said cam, and a return spring coupled to said rock arm, and the timing of said cams being one wherein said springs generally counterbalance one another.

16. Apparatus according to claim 7 wherein there is a drive shaft carrying cams, said cams forming parts of said means for oscillating said shaft and said means for reciprocating said actuator rod.

17. Apparatus according to claim 8 wherein said means for opening and closing said clamp means includes a member having a straw supporting face, and said member is moved differently when dispensing a straw from its movement when receiving a straw to assure discharge of a straw.

18. Apparatus according to claim 15 wherein said separate cam means each includes a compression spring, and the operation of said separate cam means is so timed wherein when the torque of one of said springs decreases the torque of the other of said springs increases with said springs generally counterbalancing one another.

19. A transfer apparatus for transferring open ended members from one location to another, said transfer apparatus comprising an L-shaped arm having first and second legs, a support shaft extending from said first leg as an extension thereto, opposed support pins, means mounting said support pins on said second leg for movement towards and away from each other, linkage connecting said mounting means to move said pins in opposite direction, and an actuator rod extending through said support shaft and connected to said linkage for actuating said linkage.

20. A transfer apparatus according to claim 19 wherein said mounting means for each pin includes a parallel linkage including a support bar for each pin; said linkage including a coordinating link extending between said parallel linkages, and a control lever extending between said actuator rod and said coordinating link.

21. A transfer apparatus according to claim 20 wherein said control lever forms part of one of said linkages.

22. A transfer apparatus according to claim 19 together with means mounting said support shaft for rotation about its axis, first drive means for oscillating said support shaft to position said pins, and second drive means connected to said actuator rod to move said actuator rod axially to open and close said pins.

23. A transfer apparatus according to claim 22 wherein each of said drive means is of the cam and cam follower type including a rock arm, and said cams are carried by a common drive shaft.

24. A transfer apparatus for transferring an article from a pick-up location to a discharge location with the article being oriented at said discharge location, said transfer apparatus comprising an arm, means mounting one end of said arm for pivoting about an axis, concentric first and second shafts projecting from said arm at the opposite end thereof, a carrier mounted on said first shaft for rotation therewith, article clamp means carried by said carrier, linkage connecting said clamp means to said second shaft for actuation thereby, and drive means carried by said arm and coupled to said first and second shafts for effecting rotation of said shafts.

25. A transfer apparatus according to claim 24 wherein said arm is carried by a third shaft and said first and second shafts are driven by fourth and fifth shafts respectively arranged concentric with said third shaft.

26. A transfer apparatus according to claim 25 wherein said fourth shaft is fixed against rotation and said first shaft is rotated in response to pivoting of said arm to rotationally change the position of said carrier relative to said arm.

27. A transfer apparatus according to claim 26 together with separate cam drives coupled to a common drive shaft for separately rotating said third and fifth shafts.

28. A transfer apparatus according to claim 24 wherein said carrier includes a blade having support surfaces thereon for an anticle to be transferred, said clamp means being associated with said blade for clamping an article against said support surface, and said linkage including an actuator for said clamp means, said actuator also having a support surface for an article, and said actuator being movable beyond a position wherein said clamp means are open to urge an article away from said clamp means.

29. A transfer apparatus comprising first and second transfer units, first and second shafts mounting said transfer units for separate swinging movement in timed relation and in opposite directions, drive means for separately oscillating said shafts, said drive means including counterbalancing springs, and means for timing said swinging movement to provide for the reduction of torque produced by one of said springs as torque produced by the other of said springs increases and vice versa.

30. A transfer apparatus in accordance with claim 29 wherein said drive means includes a common drive shaft, separate cams on said drive shaft, a rock member for each cam carrying a cam follower, and each of said springs placing a torque on a respective one of said rock arms.

* * * * *